US011111731B2

(12) United States Patent
Cao et al.

(10) Patent No.: US 11,111,731 B2
(45) Date of Patent: Sep. 7, 2021

(54) TECHNIQUES FOR FORMING INSTRUMENTED CUTTING ELEMENTS AND AFFIXING THE INSTRUMENTED CUTTING ELEMENTS TO EARTH-BORING TOOLS AND RELATED APPARATUSES AND METHODS

(71) Applicant: Baker Hughes Oilfield Operations LLC, Houston, TX (US)

(72) Inventors: Wanjun Cao, The Woodlands, TX (US); Juan Miguel Bilen, The Woodlands, TX (US); Steven W. Webb, The Woodlands, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 65 days.

(21) Appl. No.: 16/705,675

(22) Filed: Dec. 6, 2019

(65) Prior Publication Data

US 2021/0172259 A1 Jun. 10, 2021

(51) Int. Cl.

| | |
|---|---|
| ***E21B 10/62*** | (2006.01) |
| ***E21B 10/42*** | (2006.01) |
| ***E21B 10/60*** | (2006.01) |

(52) U.S. Cl.

CPC ..... *E21B 10/62* (2013.01); *E21B 10/42* (2013.01); *E21B 10/602* (2013.01)

(58) Field of Classification Search

CPC ..... E21B 10/42; E21B 10/43; E21B 10/46; E21B 10/54; E21B 10/55; E21B 10/56;

(Continued)

(56) References Cited

U.S. PATENT DOCUMENTS 5,176,053 A * 1/1993 Alvelid ..... B23B 27/145 374/141
7,052,215 B2 * 5/2006 Fukano ..... B23B 27/145 407/113

(Continued)

OTHER PUBLICATIONS

Cao et al., U.S. Appl. No. 16/026,881 titled Apparatuses and Methods for Attaching an Instrumented Cutting Element to an Earth-Boring Drilling Tool filed Jul. 3, 2018.

(Continued)

*Primary Examiner* — Blake E Michener
(74) *Attorney, Agent, or Firm* — TraskBritt

(57) ABSTRACT

Methods of forming earth-boring tools including one or more instrumented cutting elements may involve placing a cutting element partially within a pocket extending into a body of an earth-boring tool. The cutting element may include a first hole extending partially through a cutting element from a back side of the cutting element toward a cutting face and a second, shorter, wider hole extending partially through the cutting element from the back side toward the cutting face. The second hole may be in fluid communication with the first hole. An extension including a passageway extending through the extension may be located at least partially within the second hole, such that the passageway may be in fluid communication with the first hole. A thermocouple may be inserted through the passageway and into the first hole after affixing the cutting element in the pocket.

20 Claims, 20 Drawing Sheets

(58) Field of Classification Search
CPC ..... E21B 10/567; E21B 10/5671; E21B 10/5673; E21B 10/5676; E21B 10/573; E21B 10/5735; E21B 10/62; E21B 10/627; E21B 10/633; E21B 10/602
See application file for complete search history.

(56) References Cited

U.S. PATENT DOCUMENTS

| | | | | |
|---|---|---|---|---|
| 9,145,741 | B2 * | 9/2015 | Trinh | E21B 47/00 |
| 9,222,350 | B2 * | 12/2015 | Vaughn | E21B 47/00 |
| 9,500,070 | B2 * | 11/2016 | DiGiovanni | E21B 10/52 |
| 9,598,948 | B2 * | 3/2017 | Scott | E21B 49/003 |
| 9,606,008 | B2 * | 3/2017 | Liversage | G01K 7/16 |
| 9,995,088 | B2 * | 6/2018 | DiFoggio | G01H 15/00 |
| 10,047,566 | B2 * | 8/2018 | Vaughn | E21B 47/00 |
| 10,577,869 | B2 * | 3/2020 | Cao | E21B 10/42 |
| 10,584,581 | B2 * | 3/2020 | Cao | E21B 10/55 |
| 2010/0218993 | A1 | 9/2010 | Wideman et al. | |
| 2011/0266055 | A1 * | 11/2011 | DiGiovanni | E21B 47/002 175/50 |
| 2012/0132468 | A1 * | 5/2012 | Scott | E21B 10/46 175/50 |
| 2012/0312599 | A1 * | 12/2012 | Trinh | E21B 47/00 175/57 |
| 2012/0325564 | A1 * | 12/2012 | Vaughn | E21B 47/00 175/428 |
| 2013/0068525 | A1 * | 3/2013 | DiGiovanni | E21B 47/06 175/40 |
| 2013/0270007 | A1 | 10/2013 | Scott et al. | |
| 2013/0270008 | A1 | 10/2013 | DiGiovanni et al. | |
| 2013/0270890 | A1 * | 10/2013 | Hall | E21C 35/18 299/79.1 |
| 2014/0047776 | A1 | 2/2014 | Scott et al. | |
| 2014/0224539 | A1 | 8/2014 | Kumar et al. | |
| 2014/0326506 | A1 | 11/2014 | DiFoggio | |
| 2016/0076355 | A1 * | 3/2016 | Scott | C22C 26/00 175/40 |
| 2016/0097241 | A1 * | 4/2016 | Vaughn | E21B 10/56 175/39 |
| 2016/0153244 | A1 * | 6/2016 | Humphrey | E21B 10/56 175/39 |
| 2016/0319660 | A1 | 11/2016 | DiGiovanni et al. | |
| 2017/0175520 | A1 | 6/2017 | Scott et al. | |
| 2017/0183915 | A1 | 6/2017 | Scott et al. | |
| 2017/0204674 | A1 * | 7/2017 | Russell | E21B 10/567 |
| 2017/0292376 | A1 | 10/2017 | Kumar et al. | |
| 2018/0073303 | A1 * | 3/2018 | Bilen | C22F 1/006 |
| 2018/0230754 | A1 | 8/2018 | Cao et al. | |
| 2018/0258707 | A1 | 9/2018 | DiFoggio | |
| 2018/0320513 | A1 | 11/2018 | Scott et al. | |
| 2018/0334859 | A1 | 11/2018 | Cao et al. | |
| 2020/0011170 | A1 * | 1/2020 | Cao | E21B 10/567 |
| 2020/0011171 | A1 * | 1/2020 | Cao | E21B 47/00 |
| 2020/0181984 | A1 * | 6/2020 | Cao | B22F 5/00 |

OTHER PUBLICATIONS

Cao et al., U.S. Appl. No. 15/993,362, titled Cutting Elements, and Related Earth-Boring Tools, Supporting Substrates, and Methods filed May 30, 2019.

* cited by examiner

TECHNIQUES FOR FORMING INSTRUMENTED CUTTING ELEMENTS AND AFFIXING THE INSTRUMENTED CUTTING ELEMENTS TO EARTH-BORING TOOLS AND RELATED APPARATUSES AND METHODS

FIELD

This disclosure relates generally to earth-boring tools, cutting elements for earth-boring tools, and methods for forming a cutting element and affixing the cutting element to an earth-boring tool. More specifically, disclosed embodiments relate to methods of forming an instrumented cutting element and affixing the instrumented cutting element to an earth-boring tool that may reduce reliance on complex, time-consuming, and expensive manufacturing techniques and may better protect sensitive equipment during manufacturing.

BACKGROUND

When forming or enlarging a borehole in an earth formation, operators of earth-boring tools may utilize information collected from the downhole environment to better manually or automatically control the earth-boring tools. For example, sensors may be deployed at various locations on or within earth-boring tools to detect various environmental conditions within a borehole or operating conditions of the earth-boring tool itself proximate to the sensors. More specifically, sensors, such as temperature sensors, may be deployed in or around cutting elements of earth-boring tools to measure environmental conditions proximate to the point of contact between the cutting elements and the earth material and/or operating conditions of the cutting elements.

BRIEF SUMMARY

In some embodiments, methods of forming instrumented cutting elements and affixing the instrumented cutting elements to earth-boring tools may involve forming a first hole over a first distance partially through a cutting element from a back side of the cutting element opposite a cutting face of the cutting element toward the cutting face. The first hole may include a first maximum diameter. A second hole may be formed over a second, shorter distance partially through the cutting element from the back side of the cutting element toward the cutting face. The second hole may include a second, larger maximum diameter, and the second hole may be in fluid communication with the first hole. An extension comprising a passageway extending through the extension may be placed at least partially into the second hole, such that the passageway may be in fluid communication with the first hole. The cutting element may be affixed in a pocket extending into a body of an earth-boring tool. A thermocouple may be inserted through the passageway and into the first hole after affixing the cutting element in the pocket.

In additional embodiments, earth-boring tools may include a cutting element brazed within a pocket extending into a body of the earth-boring tool. The cutting element may include a first hole extending over a first distance partially through the cutting element from a back side of the cutting element opposite a cutting face of the cutting element toward the cutting face, the first hole including a first maximum diameter. A second hole may extend over a second, shorter distance partially through the cutting element from the back side of the cutting element toward the cutting face. The second hole may include a second, larger maximum diameter, and the second hole may be in fluid communication with the first hole. An extension may be located at least partially within the second hole, the extension including a passageway extending through the extension and in fluid communication with the first hole. A thermocouple may extend through the passageway and into the first hole. Braze material may affix the cutting element within the pocket and be exposed to a portion of the first hole located proximate to the back side of the cutting element.

In further embodiments, forming earth-boring tools including one or more instrumented cutting elements may involve brazing a cutting element in a pocket extending into a body of an earth-boring tool. A portion of a first hole located proximate to a back side of the cutting element opposite the cutting face may be exposed to flow of a braze material. The first hole may extend over a first distance partially through the cutting element from the back side toward the cutting face, the first hole including a first maximum diameter. Flow of the braze material into a second hole and into a remainder of the first hole may be inhibited utilizing an extension located at least partially within the second hole. The second hole may extend over a second, shorter distance partially through the cutting element from the back side of the cutting element toward the cutting face, and the second hole may include a second, larger maximum diameter. The second hole may be in fluid communication with the first hole located the portion of the first hole, and the extension may include a passageway extending through the extension and in fluid communication with the remainder of the first hole. A thermocouple may be inserted through the passageway defined by the extension and into the remainder of the first hole.

In other embodiments, methods of making earth-boring tools including one or more instrumented cutting elements may involve placing a cutting element partially within a pocket extending into a body of an earth-boring tool. The cutting element may include a first hole extending over a first distance partially through the cutting element from a back side of the cutting element opposite a cutting face of the cutting element toward the cutting face, the first hole including a first maximum diameter. A second hole may extend over a second, shorter distance partially through the cutting element from the back side of the cutting element toward the cutting face, the second hole including a second, larger maximum diameter, the second hole in fluid communication with the first hole. An extension including a passageway extending through the extension may be located at least partially within the second hole, the passageway in fluid communication with the first hole. The cutting element may be affixed in the pocket, and a thermocouple may be inserted through the passageway and into the first hole after affixing the cutting element in the pocket.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
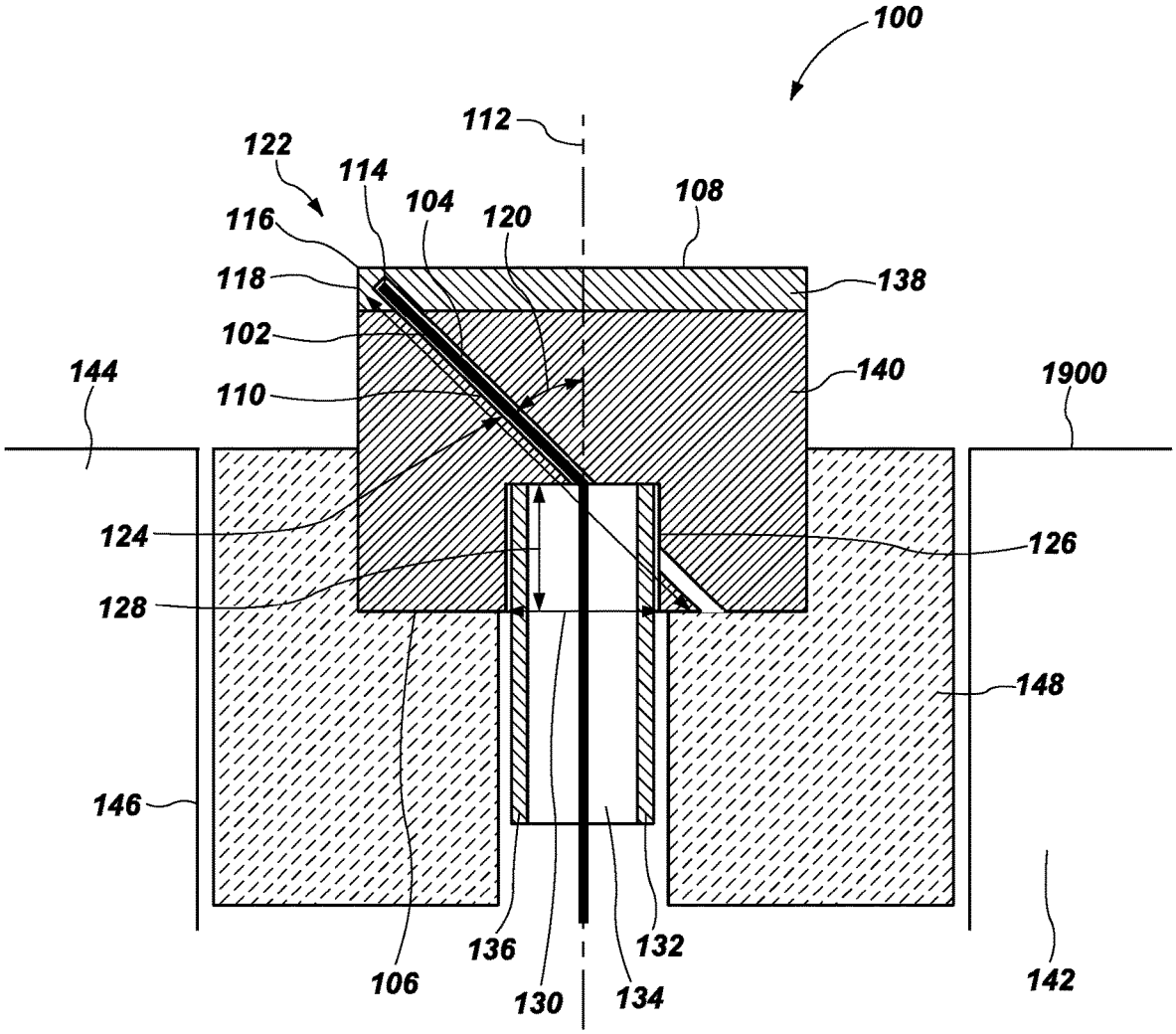
FIG. 1 is a cross-sectional side view of a cutting element in accordance with this disclosure.

The illustrations presented in this disclosure are not meant to be actual views of any particular earth-boring tool, cutting element, intermediate product in a process of forming a cutting element and/or earth-boring tool, or component thereof, but are merely idealized representations employed to describe illustrative embodiments. Thus, the drawings are not necessarily to scale.

Disclosed embodiments relate generally to methods of forming an instrumented cutting element and affixing the instrumented cutting element to an earth-boring tool that may reduce reliance on complex, time-consuming, and expensive manufacturing techniques and may better protect sensitive equipment during manufacturing.

As used herein, the terms "substantially" and "about" in reference to a given parameter, property, or condition means and includes to a degree that one of ordinary skill in the art would understand that the given parameter, property, or condition is met with a degree of variance, such as within acceptable manufacturing tolerances. For example, a parameter that is substantially or about a specified value may be at least about 90% the specified value, at least about 95% the specified value, at least about 99% the specified value, or even at least about 99.9% the specified value.

As used herein, the terms "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., bits including rolling components in combination with fixed cutting elements), and other drilling bits and tools known in the art.

As used herein, the term "superabrasive material" means and includes any material having a Knoop hardness value of about 3,000 Kgf/mm2 (29,420 MPa) or more. Superabrasive materials include, for example, diamond and cubic boron nitride. Superabrasive materials may also be characterized as "superhard" materials.

As used herein, the term "polycrystalline material" means and includes any structure comprising a plurality of grains (i.e., crystals) of material that are bonded directly together by inter-granular bonds. The crystal structures of the individual grains of the material may be randomly oriented in space within the polycrystalline material.

As used herein, the terms "inter-granular bond" and "interbonded" mean and include any direct atomic bond (e.g., covalent, metallic, etc.) between atoms in adjacent grains of superabrasive material.

As used herein, terms of relative positioning, such as "above," "over," "under," and the like, refer to the orientation and positioning shown in the figures. During real-world formation and use, the structures depicted may take on other orientations (e.g., may be inverted vertically, rotated about any axis, etc.). Accordingly, the descriptions of relative positioning must be reinterpreted in light of such differences in orientation (e.g., resulting in the positioning structures described as being located "above" other structures underneath or to the side of such other structures as a result of reorientation).

FIG. 1 is a cross-sectional side view of a cutting element 100 in accordance with this disclosure. The cutting element 100 may be configured as an instrumented cutting element, and may include at least one sensor 102 located at least partially within the cutting element 100. For example, the cutting element 100 may include a first hole 104 extending from a back side 106 (e.g., a rotationally trailing surface) of the cutting element 100 located opposite a cutting face 108 toward the cutting face 108. The first hole 104 may extend over a first distance 110 partially through the cutting element 100 from the back side 106 of the cutting element 100 toward the cutting face 108. For example, the first distance 110 over which the first hole 104 may extend may be between about 80% and about 99.9% of a longitudinal extent of the cutting element 100, as measured in a direction parallel to a longitudinal axis 112 extending perpendicular to at least one of the cutting face 108 and/or the back side 106 and located geometrically central with respect to the at least one of the cutting face 108 and/or the back side 106. More specifically, the first distance 110 over which the first hole 104 may extend may be, for example, between about 85% and about 98% of the longitudinal extent of the cutting element 100. As a specific, nonlimiting example, the first distance 110 over which the first hole 104 may extend may be, for example, between about 90% and about 95% (e.g., about 92%, about 92.5%, about 93%) of the longitudinal extent of the cutting element 100.

As a result, a terminus 114 of the first hole 104 may be located proximate to the cutting face 108, proximate to a cutting edge 116 located at an intersection between the cutting face 108 and a side surface 118 of the cutting element 100, between the cutting face 108 and a chamfer, or between the chamfer and the side surface 118, or proximate to the cutting face 108 and the cutting edge 116.

The first distance 110 over which the first hole 104 may extend, as measured in a direction perpendicular to the longitudinal axis 112, may depend on an angle 120 at which the first hole 104 is oriented relative to the longitudinal axis 112. For example, the angle 120 between the longitudinal axis 112 and a geometrically central axis of the first hole 104, as measured counterclockwise from the longitudinal axis 112 when the cutting face 108 is oriented upward, may be between about 0° and about 60°. More specifically, the angle 120 between the longitudinal axis 112 and the first hole 104 may be, for example, between about 0° and about 50°. As a specific, nonlimiting example, the angle 120 between the longitudinal axis 112 and the first hole 104 may be between about 0° and about 45° (e.g., about 15°, about 20°, about 25°, about 30°). Orienting the first hole 104 at a given angle 120 may enable a sensor 102 located within the first hole 104 to measure a characteristic proximate a desired location on the cutting element 100, such as, for example, proximate to the cutting edge 116 at a specified angular position or proximate to the cutting face 108 at a specified angular and radial position.

The first hole 104 may have a first maximum diameter 124 (i.e., a maximum distance between walls defining the first hole 104 on opposite sides thereof as measured through a geometrically central axis of the first hole 104) large enough to accommodate a sensor 102 at least partially therein and small enough to maintain sufficient structural integrity in the cutting element 100 for downhole use. The first maximum diameter 124 may be, for example, between about 0.01 inch and about 0.05 inch. More specifically, the first maximum diameter 124 may be, for example, between about 0.015 inch and about 0.045 inch. As a specific, nonlimiting example, the first maximum diameter 124 may be between about 0.02 inch and about 0.04 inch (e.g., about 0.025 inch, about 0.03 inch, about 0.035 inch).

The first hole 104 may be at least substantially straight along at least a majority of a length of the first hole 104. For example, a geometrically central axis of the first hole 104 may be an at least substantially straight line from the back side 106 to proximate the cutting face 108. As another example, the first hole 104 may lack sharp bends and/or corners within the first hole 104 itself as the first hole 104 extends to form a channel for receiving a sensor 102 at least partially within the first hole 104 from proximate to the cutting face 108 toward the back side 106.

The cutting element 100 may include a second hole 126 extending from the back side 106 of the cutting element 100 toward the cutting face 108. The second hole 126 may extend over a second distance 128 partially through the cutting element 100 from the back side 106 of the cutting element 100 toward the cutting face 108, which second distance 128 may be shorter than the first distance 110. For example, the second distance 128 over which the first hole 104 may extend may be between about 20% and about 60% of the longitudinal extent of the cutting element 100. More specifically, the first distance 110 over which the first hole 104 may extend may be, for example, between about 25% and about 50% of the longitudinal extent of the cutting element 100. As a specific, nonlimiting example, the first distance 110 over which the first hole 104 may extend may be, for example, between about 30% and about 45% (e.g., about 35%, about 40%) of the longitudinal extent of the cutting element 100. A geometrically central axis of the second hole 126 may be oriented, for example, at least substantially parallel to the longitudinal axis 112 of the cutting element 100. More specifically, the geometrically central axis of the second hole 126 forming an at least substantially straight line may be, for example, at least substantially aligned with the longitudinal axis 112 of the cutting element 100. In other words, the second hole 126 may be located geometrically centrally with respect to the back side 106 of the cutting element 100.

As a result of the length, position, and orientation of the second hole 126 and the length, position, and orientation of the first hole 104, the second hole 126 may be in fluid communication with the first hole 104. For example, fluids may be capable of flowing from the second hole 126 to the first hole 104 and vice versa when the second hole 126 and the first hole 104 are devoid of obstructions therebetween (e.g., are exposed to environmental fluids, such as air, and are otherwise empty). More specifically, the first hole 104 and the second hole 126 may intersect with one another, such that access to an intermediate portion of the first hole 104 spaced from the terminus 114 and the back side 106 may be granted via the second hole 126. This communication between the first hole 104 and the second hole 126 may also enable a sensor 102 to be inserted at least partially into the first hole 104 via the second hole 126. For example, a sensor 102 and/or associated wiring for the sensor 102 may extend from the terminus 114 of the first hole 104 or proximate to the terminus 114 of the first hole 104, through a portion of the first hole 104, through the second hole 126, and beyond the back side 106 of the cutting element 100 via the second hole 126 to be wired to a receiving device.

The second hole 126 may have a second, larger maximum diameter 130 (i.e., a maximum distance between walls defining the second hole 126 on opposite sides thereof as measured through a geometrically central axis of the second hole 126) when compared to the first maximum diameter 124 of the first hole 104. The second, larger maximum diameter 130 may be, for example, between about 0.1 inch and about 0.4 inch. More specifically, the second, larger maximum diameter 130 may be, for example, between about 0.125 inch and about 0.3 inch. As a specific, nonlimiting example, the second, larger maximum diameter 130 may be between about 0.15 inch and about 0.25 inch (e.g., about 0.175 inch, about 0.2 inch).

The cutting element 100 may include an extension 132 (which may also be referred to as a "plug" in some embodiments) located at least partially within the second hole 126. The extension 132 may be sized, shaped, and configured to enable a sensor 102 to pass through the extension 132 and the second hole 126 into the first hole 104 while inhibiting flow of other materials into the extension 132, the second hole 126, and at least a portion of the first hole 104. For example, the extension 132 may be configured generally as a tube, and may include a passageway 134 extending longitudinally through the extension 132 and sidewalls 136 defining the passageway 134 and circumferentially surrounding the passageway 134. A cross-sectional shape of the extension 132, as taken in a plane perpendicular to the longitudinal axis 112, may be, for example, circular, oval, rectangular, hexagonal, or otherwise polygonal. More specifically, the extension 132 may be generally configured as a right cylinder. In some embodiments, the sidewalls 136 of the extension 132 may extend beyond the back side 106 of the cutting element 100, such that the passageway 134 may likewise extend from within the cutting element 100 (optionally from a point of intersection with the first hole 104), beyond the back side 106 of the cutting element 100, to an opening located on a side of the extension 132 opposite the cutting face 108.

In some embodiments, the extension 132 may be a discrete component from the substrate 140 for insertion at least partially into the second hole 126. The extension 132 may be affixed to the substrate 140. For example, sidewalls 136 of the extension 132 may be affixed to the substrate 140 by an interference fit with sidewalls of the second hole 126, by a shrink fit with sidewalls of the second hole 126, by a weld, by a braze, by a threaded connection (e.g., threads on the exterior of the extension 132 engaged with mating threads in the sidewalls of the substrate 140 defining the second hole 126), or by an adhesive. More specifically, the extension 132 may be affixed to the substrate 140 by, for example, frictional interference with sidewalls 136 of the second hole 126. In other embodiments, particularly those where the first hole 104 does not include a trailing portion proximate to the back side 106 of the cutting element 100 (see, e.g., FIG. 9 and FIG. 10), the extension 132 may be an integral component of (e.g., may be of the same material and may be formed at the same time as) the substrate 140.

The extension 132 may include and/or be formed from a material or materials suitable for use in the downhole environment. For example, the extension 132 may include and/or be formed from metal, metal alloy, ceramic, particle-matrix, and/or fiber-matrix composite materials. More specifically, the extension 132 may include and/or be formed from a steel material.

A sensor 102 may be located at least partially within the first hole 104. The sensor 102 may be configured to detect, for example, temperature. More specifically, the sensor 102 may include, for example, a thermocouple. The sensor 102 and/or the sensor 102 and associated wiring may extend, for example, from the terminus 114 or proximate to the terminus 114 of the first hole 104, through a first portion of the first hole 104 extending between the terminus 114 and the second hole 126, into the second hole 126 and the passageway 134 within the extension 132, through the second hole 126 and beyond the back side 106 of the cutting element 100, through the passageway 134 and beyond the extension 132, toward a receiving device, such as, for example, a local storage and/or computing device or a local transmission device for transmission to a remote storage and/or computing device. A remainder of the first hole 104 extending from the second hole 126 to the back side 106 of the cutting element 100 may be exposed to the environment, and environmental may be able to flow at least substantially unimpeded from the back side 106 of the cutting element 100, into the remainder of the first hole 104, up to a location where the first hole 104 intersects with the second hole 126 and is obstructed by the sidewalls 136 of the extension 132.

The cutting element 100 may generally be shaped as, for example, a cylinder, disc, dome-topped cylinder, a cone-topped cylinder, a tombstone, a chisel, an indenter. More specifically, the cutting element 100 may generally be shaped as a right cylinder including the first hole 104 and the second hole 126 therein, and optionally including one or more chamfer surfaces at transition regions between the cutting face 108 and the side surface 118 and between the back side 106 and the side surface 118.

In some embodiments, the cutting element 100 may include a table 138 of or including a polycrystalline, superabrasive material affixed to an end of a substrate 140 of or including a hard material suitable for use in the downhole environment. For example, the table 138 may be formed of or include polycrystalline diamond and/or polycrystalline cubic boron nitride, and many include a metal or metal alloy material (e.g., a solvent catalyst material, such as Group VIII-A metals and/or alloys including Group VIII-A metals) in some or all of the interstitial spaces among interbonded grains of the diamond and/or cubic boron nitride material. More specifically, the table 138 may be formed from and/or include a polycrystalline diamond material having one or more regions including cobalt, nickel, iron, alloys and/or mixtures thereof in the interstitial spaces among interbonded diamond grains and one or more other regions lacking solid material in the interstitial spaces. The substrate 140 may include, for example, a metal, metal alloy (e.g., steel), particle-matrix, or fiber-matrix material. More specifically, the substrate 140 may include, for example, particles of or including ceramic material bound in a matrix of or including a metal or metal alloy material. As a specific, nonlimiting example, the substrate 140 may include tungsten carbide particles bound in a matrix of cobalt, nickel, iron, alloys and/or mixtures thereof. In other embodiments, the cutting element 100 may lack a dedicated table 138, and may include a substrate 140 (e.g., an insert) of or including hard and/or superabrasive materials suitable for use in the downhole environment. For example, the cutting element 100 may include a cobalt-cemented tungsten carbide substrate 140, optionally impregnated with particles of or including superabrasive material (e.g., diamond-impregnated).

The cutting element 100 may be affixed to an earth-boring tool 1900, and may be positioned and oriented to contact and remove an adjacent earthen material in response to applied force in an intended direction of removal and movement (e.g., rotation) of the earth-boring tool 1900. For example, the earth-boring tool 1900 may be configured as a fixed-cutter earth-boring drill bit, and may include a body 142 having blades 144 extending longitudinally and radially outward from a remainder of the body 142 with junk slots between rotationally adjacent blades 144. Each blade 144 may include one or more pockets 146 extending into the blade 144, such as, for example, from a rotationally leading surface of the blade 144 into the rotationally trailing mass of the blade 144. Each pocket 146 may be sized and shaped to receive a corresponding cutting element therein, optionally an instrumented cutting element 100 as shown in FIG. 1. The pocket 146, at full diameter or reduced diameter rotationally trailing the cutting element 100 or the extension 132, may extend entirely through a rotational thickness of the blade 144 to enable routing of signals from the sensor 102 via associated wiring.

The cutting element 100 may be affixed within the pocket 146 by, for example, a braze material 148 interposed between, and affixed to, at least portions of the sidewalls 136 of the cutting element 100 and portions of the surfaces of the blade 144 defining the pocket 146. More specifically, the braze material 148 may be interposed between, and affixed to, portions of the sidewalls 136, portions of the back side 106, and portions of the extension 132 of the cutting element 100 100 and portions of the surfaces of the blade 144 defining the pocket 146. As a specific, nonlimiting example, the braze material 148 may be interposed between, and affixed to, a majority of the sidewalls 136 around a circumference of the cutting element 100, an at least substantial entirety of the back side 106 around the extension 132, an at least substantial entirety of a radial exterior of the extension 132 rotationally trailing the back side 106 at least over those portions of the longitudinal extent of the extension 132 where the pocket 146 is at its maximum diameter and at least those surfaces of the blade 144 defining the pocket 146 where the pocket 146 is at or proximate to its maximum diameter.

In embodiments where the angle 120 between the first hole 104 and the longitudinal axis 112 is sufficiently large that there is a portion of the first hole 104 extending between the back side 106 of the cutting element 100 and the second hole 126, which may be obstructed by the sidewalls 136 of the extension 132 from establishing fluid communication with the second hole 126, that portion of the first hole 104 may be exposed to the braze material 148. For example, the portion of the first hole 104 extending between the back side 106 and the second hole 126 and located on a lateral side of the longitudinal axis 112 opposite a lateral side on which the portion of the first hole 104 proximate to the cutting face 108 is located may be at least substantially free of mechanical obstructions (e.g., extensions, walls, barriers) that would impede the flow of fluid into the first hole 104 up to the location where the first hole 104 is blocked by the extension 132. More specifically, the only obstacle to the flow of fluid, such as the braze material 148 in a flowable state, into the portion of the first hole 104 extending between the back side 106 and the second hole 126 may be, for example, any difficulty of displacing fluid already located therein, such as, for example, air. As a specific, nonlimiting example, at least trace amounts of the braze material 148 may be located in the first hole 104 proximate to the back side 106, and up to at least substantially an entirety of the portion of the first hole 104 extending between the back side 106 and the second hole 126 may be at least substantially filled with the braze material 148. In other embodiments where the angle 120 between the first hole 104 is sufficiently low, there may not be any remaining portion of the first hole 104 extending from the second hole 126 to the back side 106 because that portion of the first hole 104 may be subsumed into the second hole 126.

Figure 2:
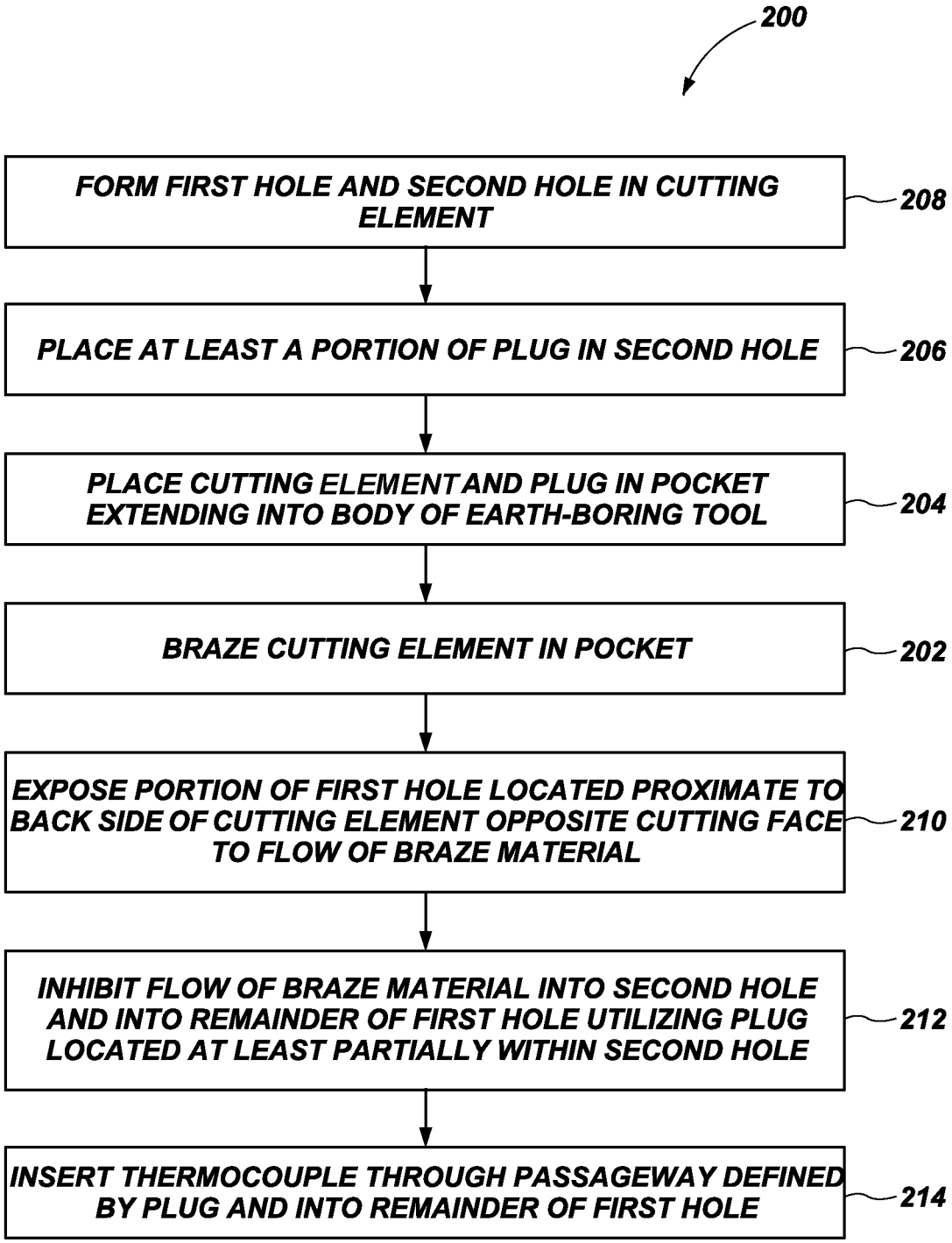
FIG. 2 is a flowchart of a method of forming a cutting element and affixing the cutting element to an earth-boring tool.

FIG. 2 is a flowchart of a method 200 of forming a cutting element, such as the cutting element 100 of FIG. 1, and affixing the cutting element to an earth-boring tool. The method 200 may involve forming the first hole 104 and the second hole 126 in the cutting element, as reflected at act 208.

Figure 3:
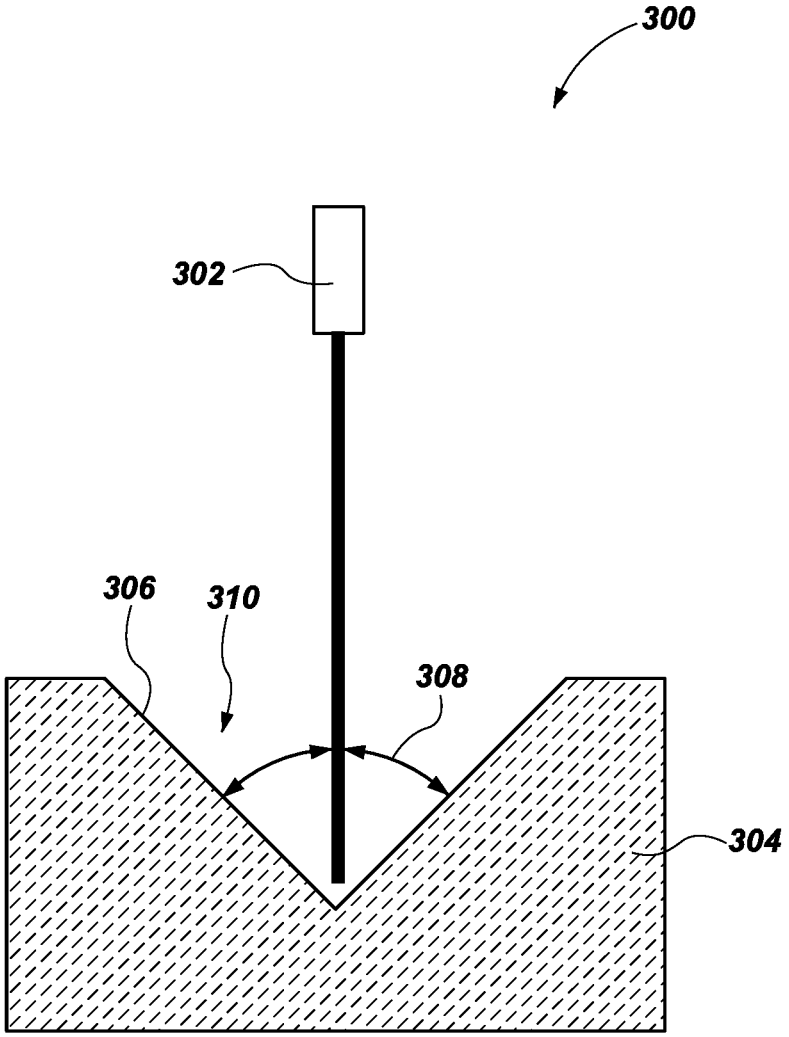
FIG. 3 is a cross-sectional side view of a hole formation system for forming one or more holes of the cutting element of FIG. 1.

FIG. 3 is a cross-sectional side view of a hole formation system 300 for forming one or more holes of the cutting element 100 of FIG. 1, and carrying out at least a portion of act 208 of the method 200 of FIG. 2. The hole formation system 300 may include, for example, a material remover 302 configured to remove material of the cutting element 100 (see FIG. 1) to form at least one of the first hole 104 and/or the second hole 126 (see FIG. 1). The material remover 302 may include, for example, a laser drill or an electrical discharge machining apparatus.

The hole formation system 300 may further include a support 304 shaped, positioned, and configured to support the cutting element 100 (see FIG. 1) in a predetermined orientation and position relative to the hole formation system 300. The support 304 may include surfaces 306 oriented to contact and support the side surface 118 and the cutting face 108 of the cutting element 100 and maintain the cutting element 100 (see FIG. 1) in a predetermined orientation while the material remover 302 forms at least the first hole 104 and optionally in another orientation while the material remover 302 forms the second hole 126. More specifically, the surfaces 306 of the support may form a recess 310 with an angle 308 between the surfaces 306 being at least substantially equal to the angle between the side surface 118 and the cutting face 108 of the cutting element 100, and a ray extending from the material remover 302 may intersect that angle 308 such that a portion of the angle 308 on a lateral side of the ray proximate to the surface 306 for supporting the side surface 118 (see FIG. 1) may be equal to the angle 120 (see FIG. 1) at which the first hole 104 (see FIG. 1) is to extend. As a specific, nonlimiting example, the recess 310 defined by the surfaces 306 of the support 304 may be at least substantially the inverse shape of the cutting element 100 (see FIG. 1) to be received therein, though larger by at least a passthrough fit to more easily enable the cutting element 100 (see FIG. 1) to be placed in the recess 310.

Figure 4:
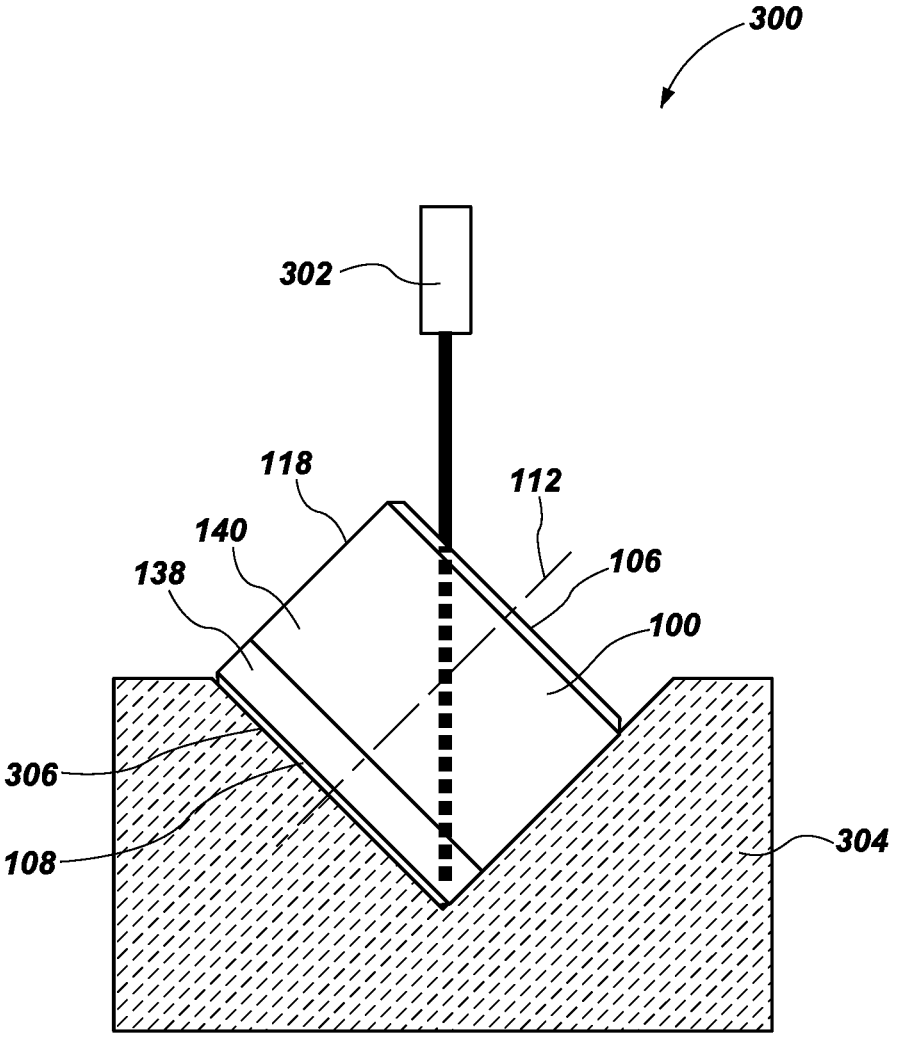
FIG. 4 is a cross-sectional side view of the hole formation system of FIG. 3 during a process of forming one or more holes in the cutting element of FIG. 1.

FIG. 4 is a cross-sectional side view of the hole formation system 300 of FIG. 3 during a process of forming one or more holes in the cutting element 100 of FIG. 1 in accordance with act 208 of the method 200 of FIG. 2. The cutting element 100 may be positioned in the recess 310 on the surfaces 306 of the support 304. If not already done, the longitudinal axis 112 of the cutting element 100 may be positioned so as to intersect with energy emitted by the material remover 302. The material remover 302 may then be activated, removing material of the cutting element 100 until the first hole 104 is complete. More specifically, the material remover 302 may remove material of the substrate 140 and material of the table 138 when the cutting element 100 includes the table 138 by laser drilling or electrical discharge machining until the first hole 104 is complete.

Figure 5:
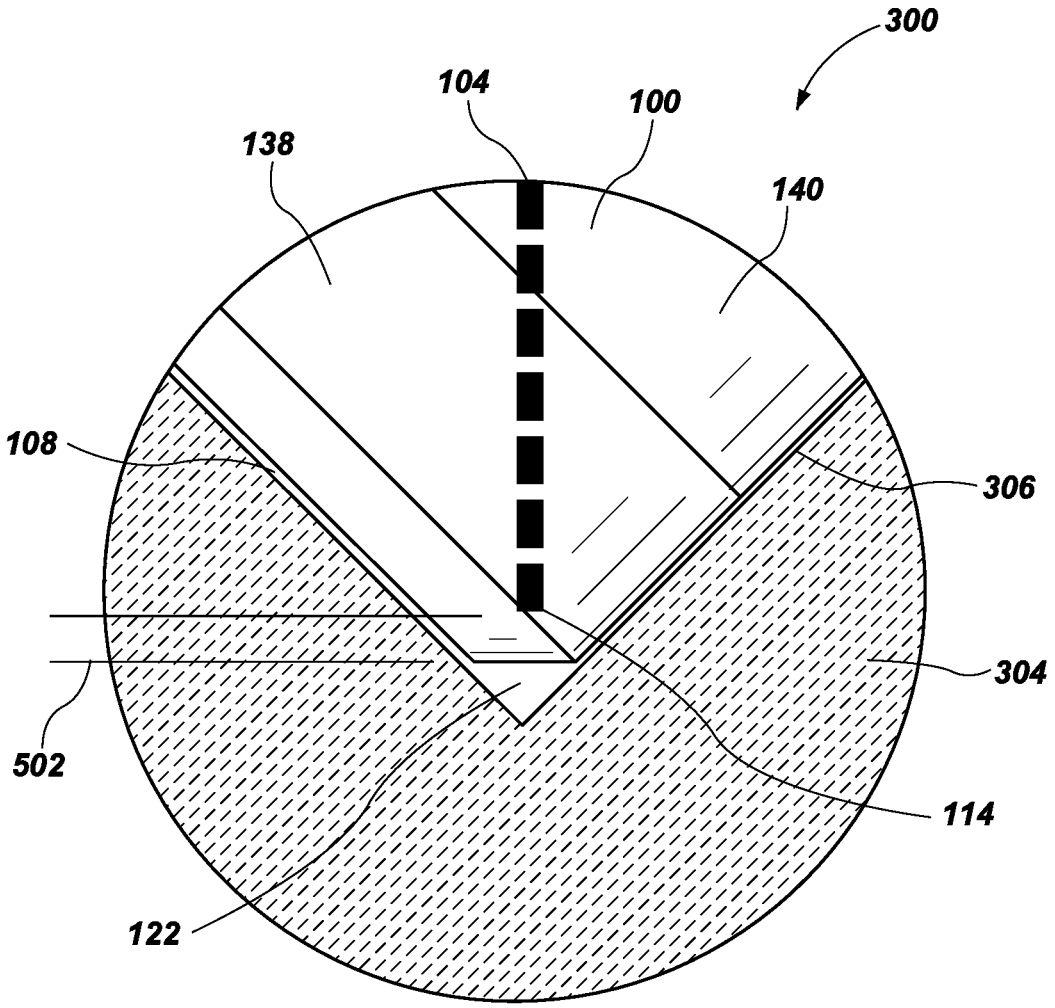
FIG. 5 is an enlarged cross-sectional side view of the hole formation system of FIG. 4.

FIG. 5 is an enlarged cross-sectional side view of the hole formation system 300 of FIG. 4 in accordance with act 208 of the method 200 of FIG. 2. A shortest distance 502 between the terminus 114 of the first hole 104 and the exterior 122 may be, for example, between about 0.01 inch and about 0.1 inch. More specifically, the shortest distance 502 between the terminus 114 of the first hole 104 and the exterior 122 of the cutting element 100 may be, for example, between about 0.02 inch and about 0.08 inch. As a specific, nonlimiting example, the shortest distance between the terminus 114 of the first hole 104 and the exterior 122 of the cutting element 100 may be between about 0.025 inch and about 0.075 inch (e.g., about 0.03 inch, about 0.04 inch, about 0.05 inch, about 0.06 inch).

Figure 6:
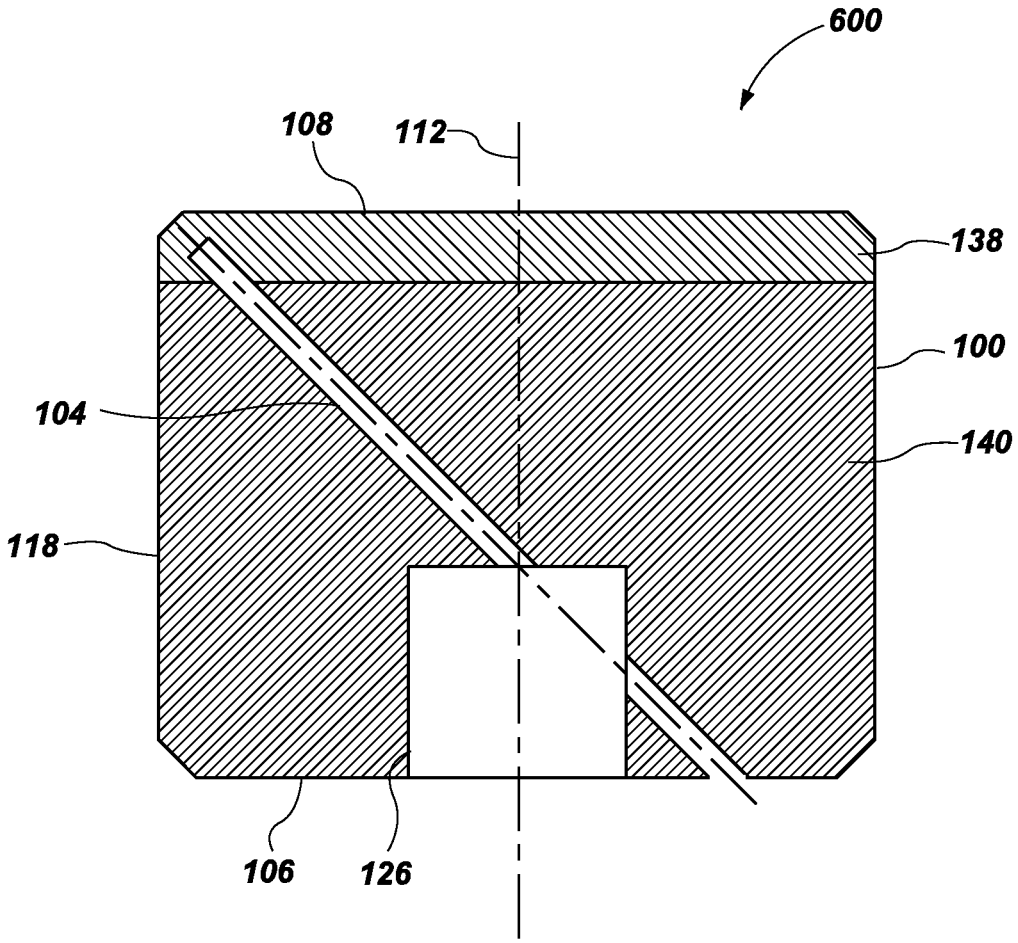
FIG. 6 is a cross-sectional side view of a first intermediate product in a process of forming the cutting element of FIG. 1 following hole formation.

FIG. 6 is a cross-sectional side view of a first intermediate product 600 in a process of forming the cutting element 100 of FIG. 1 following hole formation. The first intermediate product 600 may include the cutting element 100 having the first hole 104 and the second hole 126 formed therein. The second hole 126 may be formed by, for example, a material removal process, such as those described previously in connection with FIG. 3 and FIG. 4, machining, or drilling, and/or by forming the second hole 126 integrally with the cutting element 100 or at least the substrate 140 thereof. For example, a container for forming the cutting element 100 (or at least the substrate 140 thereof) may include a protrusion having a shape that is at least substantially the inverse of the second hole 126 to be formed, or a sacrificial blank having a shaped that is at least substantially the inverse of the second hole 126 to be formed may be positioned in the container, and the cutting element 100 (or at least the substrate 140 thereof) may be formed around the protrusion or sacrificial blank. The protrusion or sacrificial blank may then be removed, leaving the second hole 126 or a recess that may be enlarged and/or smoothed using a material removal process (e.g., one of those described previously in connection with FIG. 3 and FIG. 4). In embodiments where the second hole 126 is formed by a material removal process, the second hole 126 may be formed before or after the first hole 104. In embodiments where the second hole 126 is at least partially formed integrally with the cutting element 100 (or at least the substrate 140 thereof), the second hole 126 may be at least partially formed before the first hole 104, though any subsequent enlargement or smoothing of the second hole 126 may take place before, concurrently with, or after formation of the first hole 104.

Figure 7:
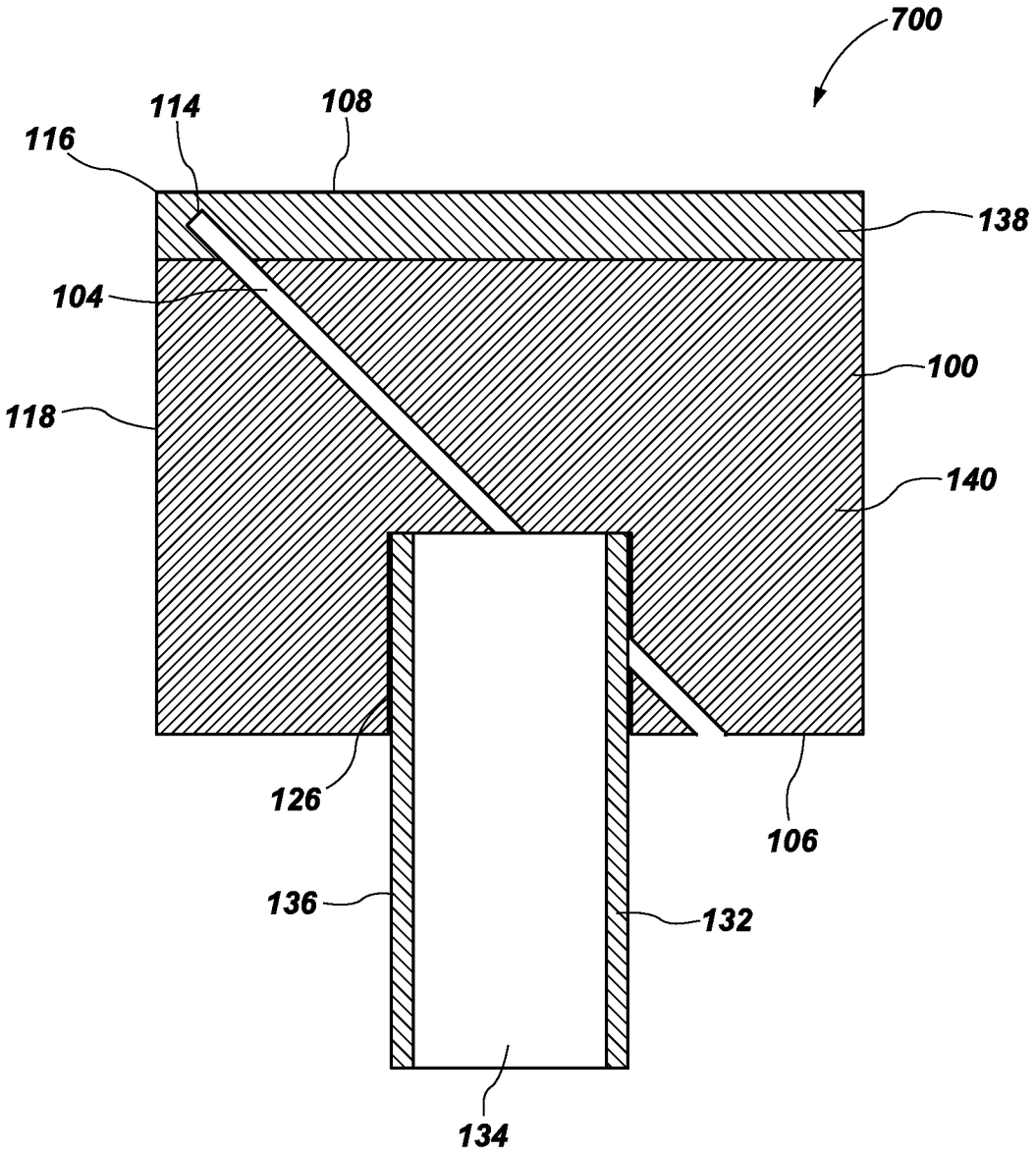
FIG. 7 is a cross-sectional side view of a second intermediate product in the process of forming the cutting element of FIG. 1 including an extension at least partially inserted into one of the holes.

Returning to FIG. 2, the method 200 may further involve placing the extension 132 at least partially in the second hole 126, as reflected at act 206. FIG. 7 is a cross-sectional side view of a second intermediate product 700 in the process of forming the cutting element 100 of FIG. 1 including an extension at least partially inserted into one of the holes. The extension 132 may be sized such that as complete insertion of the extension 132 into the second hole 126 as practical, with an end of the extension 132 contacting the cutting element 100 (or at least the substrate 140 thereof) at the bottom of the second hole 126 distal from the back side 106, may result in, for example, a remainder of the extension 132 extending longitudinally beyond the back side 106 of the cutting element 100. Following insertion of the extension 132, at least the portion of the first hole 104 extending from the passageway 134 extending through the extension 132 to the terminus 114 proximate to the cutting face 108 and/or the cutting edge 116 may be in fluid communication with the passageway 134. In embodiments where the position and orientation of the first hole 104 and second hole 126 produce a remainder of the first hole 104 extending from the second hole 126 to the back side 106, that remainder may be obstructed from being in fluid communication with the second hole 126 by the sidewalls 136 of the extension 132.

Figure 8:
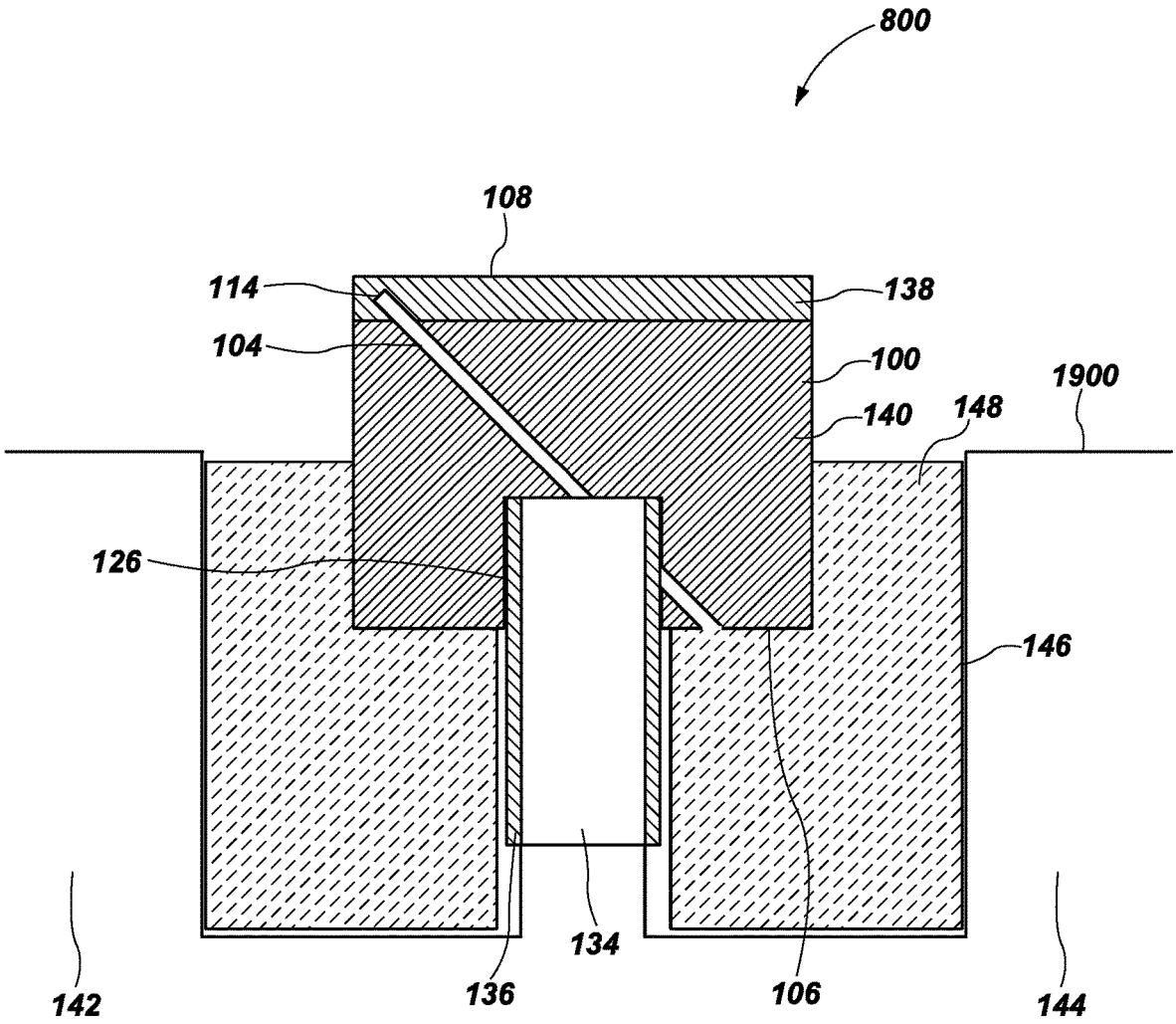
FIG. 8 is a cross-sectional side view of a third intermediate product in the process of forming the cutting element of FIG. 1 after brazing within a pocket extending into a body of an earth-boring tool.

Returning again to FIG. 2, the method 200 may involve placing the cutting element 100 and extension 132 at least partially within a pocket 146 extending into a body 142 of an earth-boring tool 1900, as shown at act 204, and brazing the cutting element 100 in the pocket 146, as shown at act 202. FIG. 8 is a cross-sectional side view of a third intermediate product 800 in the process of forming the cutting element 100 of FIG. 1 after brazing the cutting element 100 partially within the pocket 146 extending into the body 142 of the earth-boring tool 1900. The cutting element 100 may be inserted into the pocket 146 manually and held in position by virtue of mechanical interference with features of the pocket 146 or by a holder (e.g., a clamp). Brazing the cutting element 100 to affix the cutting element 100 to the body 142 of the earth-boring tool 1900 within the pocket 146 may involve, for example, placing solid braze material 148 (e.g., in the form of a wire) proximate to the cutting element 100 and the pocket 146, heating the braze material 148 (e.g., by application of a heat source of a torch, such as a welding torch or plasma arc) to place the braze material 148 in a flowable state at least substantially without placing materials of the cutting element 100 and the earth-boring tool 1900 in a flowable state, flowing the braze material 148 into the pocket 146 around the side surface 118 of the cutting element 100 and around the sidewalls 136 of the extension 132.

With collective reference to FIG. 2 and FIG. 8, the method 200 may involve exposing the portion of the first hole 104 located proximate to the back side 106 of the cutting element 100 and extending from the back side 106 to the second hole 126 to the flow of the braze material 148, as reflected at act 210. For example, the braze material 148 may be free to flow into the pocket 146 around the side surface 118 of the cutting element 100, around at least a portion of the sidewalls 136 of the extension 132, and over and potentially into the portion of the first hole 104 extending between the back side 106 of the cutting element 100 and the second hole 126. The method 200 may also involve inhibit flow of the braze material 148 into the second hole 126 and into the remainder of the first hole 104 utilizing the extension 132, as reflected at act 212. For example, the braze material 148 may be inhibited (e.g., obstructed, prevented) from flowing into the second hole 126, the passageway 134 of the extension 132, and the portion of the first hole 104 extending between the second hole 126 and the terminus 114 of the first hole 104 by the sidewalls 136 of the extension 132 inhibiting flow from the portion of the first hole 104 extending from the back side 106 to the second hole 126 into the second hole 126 and by the sidewalls 136 of the extension 132 inhibiting flow from the pocket 146 into the passageway 134 and the portion of the first hole 104 extending from the second hole 126 to the terminus 114.

Once the braze material 148 has been flowed around the circumference of at least a portion of the cutting element 100 and at least a portion of the extension 132 within the pocket 146, the braze material 148 may be permitted to cool and solidify, affixing the cutting element 100 to the body 142 of the earth-boring tool 1900 within the pocket 146. The braze material 148 may at least substantially fill, for example, those portions of the pocket 146 not occupied by the cutting element 100, the extension 132, the passageway 134 extending through the extension 132, the second hole 126 extending partially through the cutting element 100 from the back side 106 toward the cutting face 108, and the portion of the first hole 104 extending from the second hole 126 to the terminus 114. More specifically, the braze material 148 may completely fill the aforementioned regions of the pocket 146 but for any air pockets formed due to manufacturing limitations and any air not displaced from the portion of the first hole 104 extending form the second hole 126 to the back side 106 in embodiments where the first hole 104 includes such a portion as reflected at act 214.

Referring now collectively to FIG. 1 and FIG. 2, the sensor 102 may then be inserted through the passageway 134 defined by the extension 132 and into the portion of the first hole 104 extending from the second hole 126 toward the cutting face 108 and/or cutting edge 116, as reflected at act 202 of the method 200 of FIG. 2 and as shown in FIG. 1. More specifically, the sensor 102 may be inserted into the passageway 134 via an access hole in a rotationally trailing portion of the blade 144 and in fluid communication with the passageway 134, through the rotationally trailing portion of the blade 144, into the passageway 134 from a rotationally trailing end thereof, longitudinally entirely through the passageway 134 to the portion of the first hole 104 extending from the second hole 126 to the terminus 114, into that portion of the first hole 104, and at least substantially entirely through that portion of the first hole 104 to or proximate to the terminus 114. The sensor 102 itself, or wiring extending therefrom, may be routed to, for example, a storage, processing, and/or transmission module associated with the earth-boring tool 1900 to receive, store, analyze, and/or transmit signals generated by the sensor 102 in response to conditions detected thereby.

Figure 9:
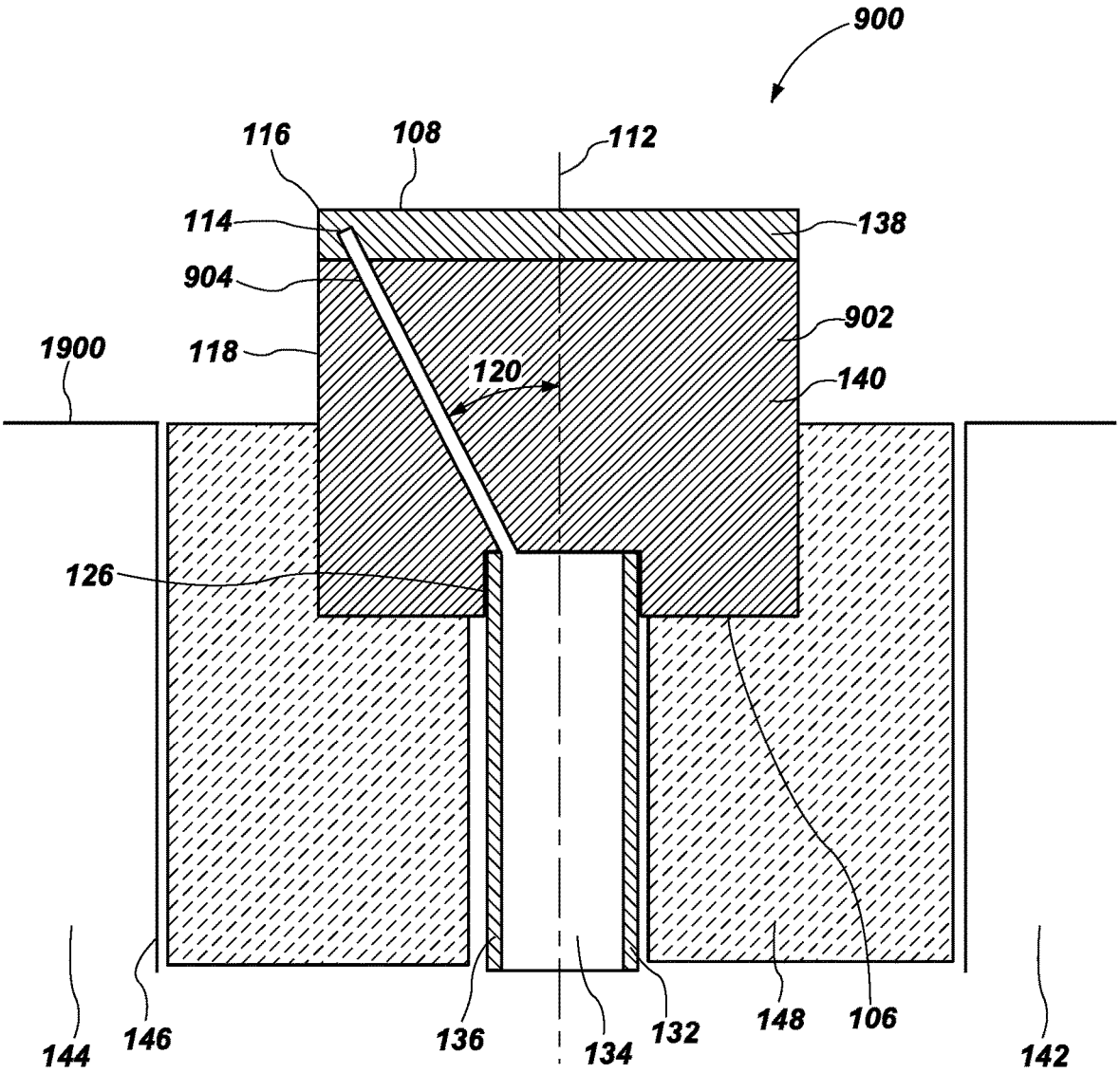
FIG. 9 is a cross-sectional side view of another embodiment of a third intermediate product in another process of forming another cutting element.

FIG. 9 is a cross-sectional side view of another embodiment of a third intermediate product 900 in another process of forming another cutting element 902. The other cutting element 902 may be at least substantially similar to the cutting element 100 of FIG. 1, with at least some notable differences highlighted below. In some embodiments, cutting elements in accordance with this disclosure, such as the other cutting element 902 of FIG. 9, may include another first hole 904 lacking any portion extending from the second hole 126 to the back side 106 of the other cutting element 902. For example, the other first hole 104 may extend from the terminus 114 proximate to the cutting face 108 and/or the cutting edge 116 of the other cutting element 902 to the second hole 126 and, due to the position and orientation of the other first hole 904, a geometrically central axis of the other first hole 904 forming an at least substantially straight line from the terminus 114 toward the second hole 126 may intersect with the second hole 126 only once within the longitudinal extent of the other cutting element 902. Such a configuration may be more likely to occur when the angle 120 at which the first hole 104 is oriented relative to the longitudinal axis 112 is relatively small. For example, the configuration for the other first hole 904 lacking a portion proximate to the back side 106 may be more likely to occur when the angle 120 at which the first hole 104 is oriented relative to the longitudinal axis 112 is between about 0° and about 40°. More specifically, the configuration for the other first hole 904 lacking a second intersection with the second hole 126 may be more likely to occur when the angle 120 at which the first hole 104 is oriented relative to the longitudinal axis 112 is, for example, between about 0° and about 35°. A sensor 102 (see FIG. 1) positioned in such another first hole 904 may be positioned to detect operating characteristics at and/or proximate an intermediate region of the cutting face 108, and may be located radially distal from both of the cutting edge 116 and the longitudinal axis 112.

Figure 10:
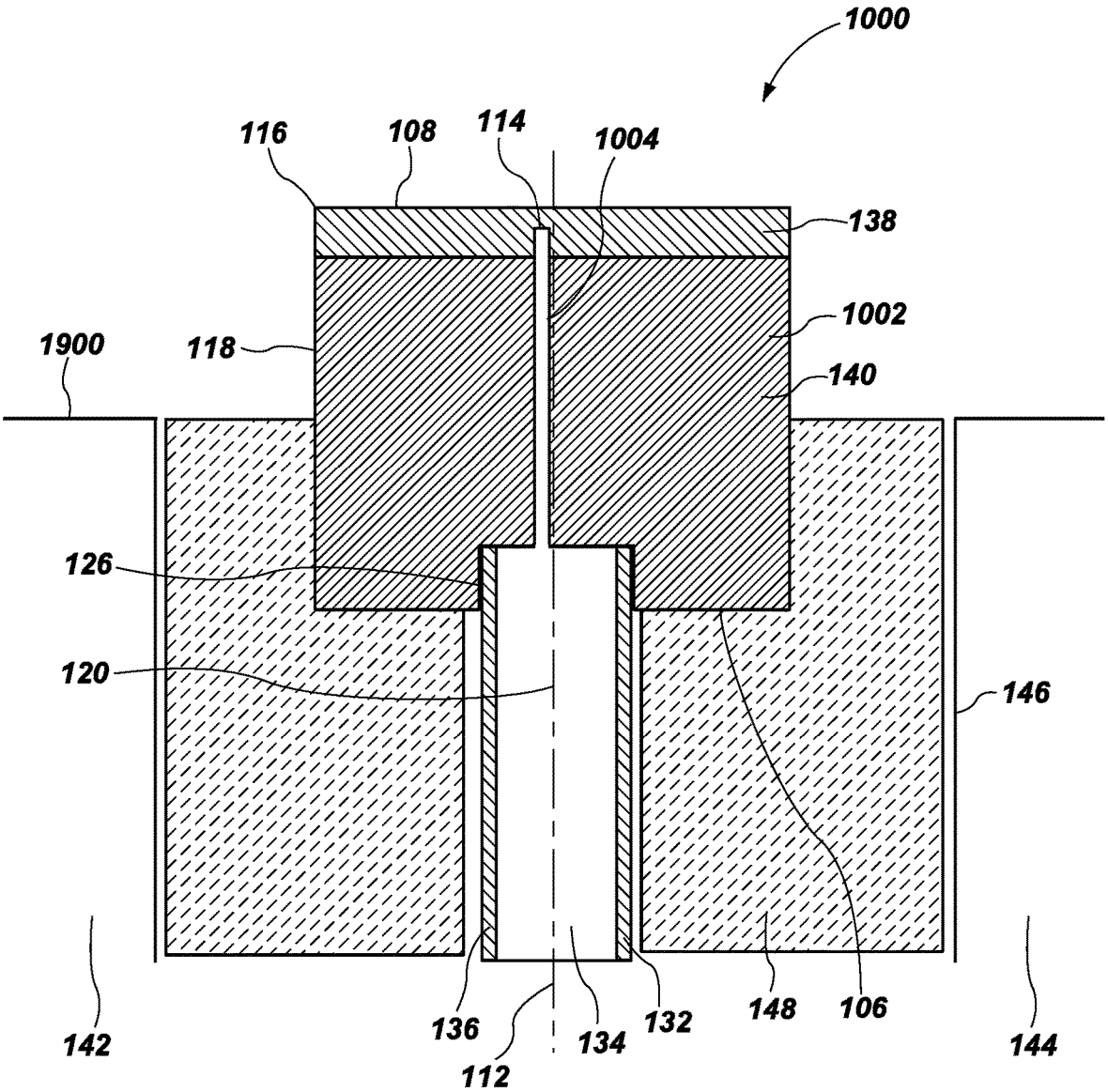
FIG. 10 is a cross-sectional side view of yet another embodiment of a third intermediate product in another process of forming another cutting element.

FIG. 10 is a cross-sectional side view of yet another embodiment of a third intermediate product 1000 in another process of forming another cutting element 1002. The other cutting element 1002 may be at least substantially similar to the cutting element 100 of FIG. 1, with at least some notable differences highlighted below. In some embodiments, cutting elements in accordance with this disclosure, such as the other cutting element 1002 of FIG. 10, may include another other first hole 1004 having a geometrically central axis at least substantially aligned with the longitudinal axis 112 of the other cutting element 1002. For example, the angle 120 at which the first hole 104 is oriented relative to the longitudinal axis 112 may be about 0°. A sensor 102 (see FIG. 1) positioned in such another first hole 1004 may be positioned to detect operating characteristics at and/or proximate a central portion of the cutting face 108, and may be located radially distal from the cutting edge 116 and proximate to the cutting edge 116.

Figure 11:
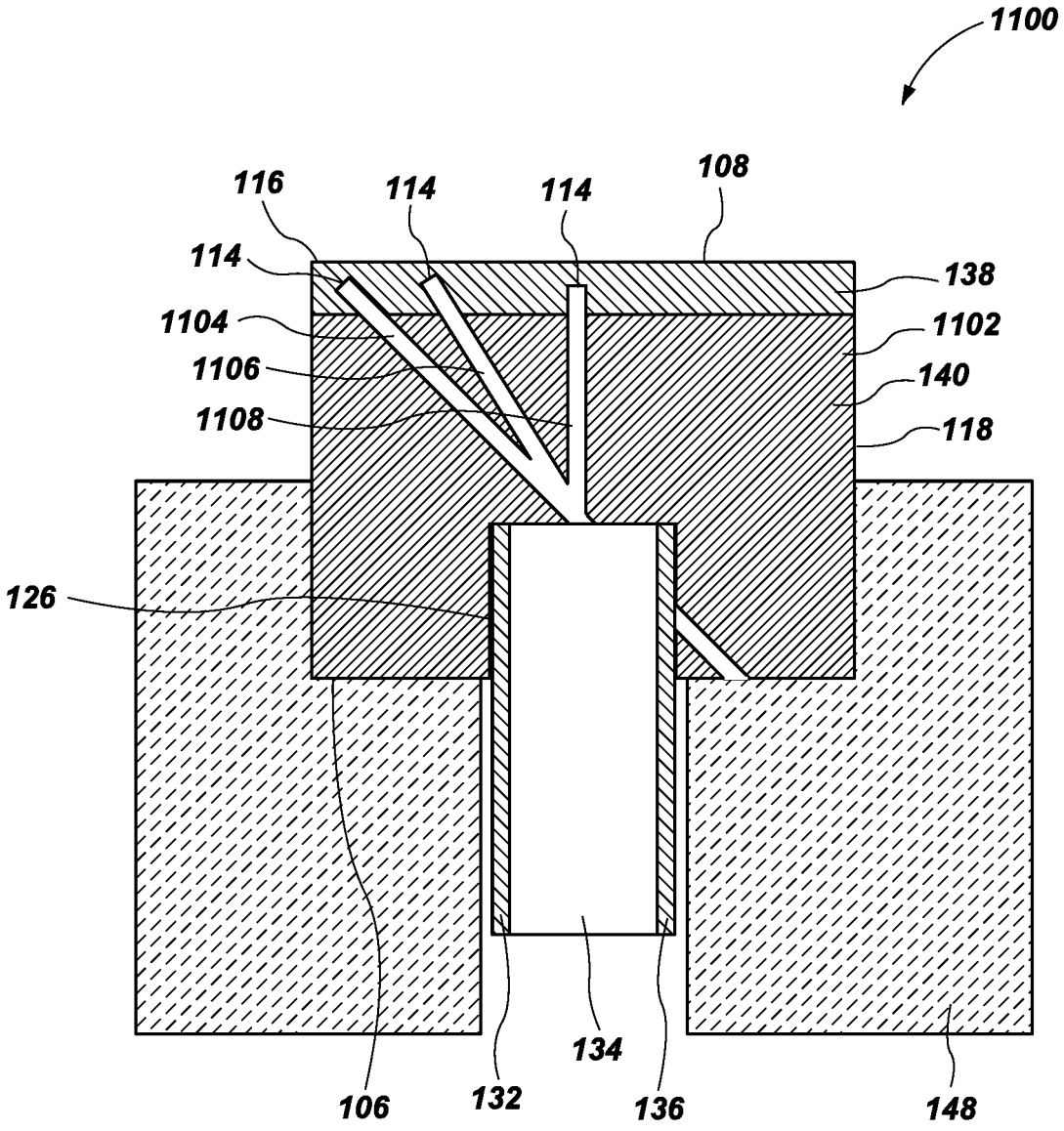
FIG. 11 is a cross-sectional side view of still another embodiment of a third intermediate product in another process of forming another cutting element.

FIG. 11 is a cross-sectional side view of still another embodiment of a third intermediate product 1100 in another process of forming another cutting element 1102. The other cutting element 1102 may be at least substantially similar to the cutting element 100 of FIG. 1, with at least some notable differences highlighted below. In some embodiments, cutting elements in accordance with this disclosure, such as the other cutting element 1102 of FIG. 11, may include more than one first hole, such as, for example, the first other first hole 1104, second other first hole 1106, and third other first hole 1108 of the other cutting element 1102 of FIG. 11. The first other first hole 1104 may be at least substantially the same as the first hole 104 described previously in connection with FIG. 1 through FIG. 8, the second other first hole 1106 may be at least substantially the same as the other first hole 904 described previously in connection with FIG. 9, and the third other first hole 1108 may be at least substantially the same as the other first hole 1004 described previously in connection with FIG. 10. Separate sensors 102 may be located in a given respective one of the first other first hole 1104, second other first hole 1106, or third other first hole 1108, or separate probing portions of a single sensor 102 may be individually positioned in a given one of the first other first hole 1104, second other first hole 1106, or third other first hole 1108.

Figure 12:
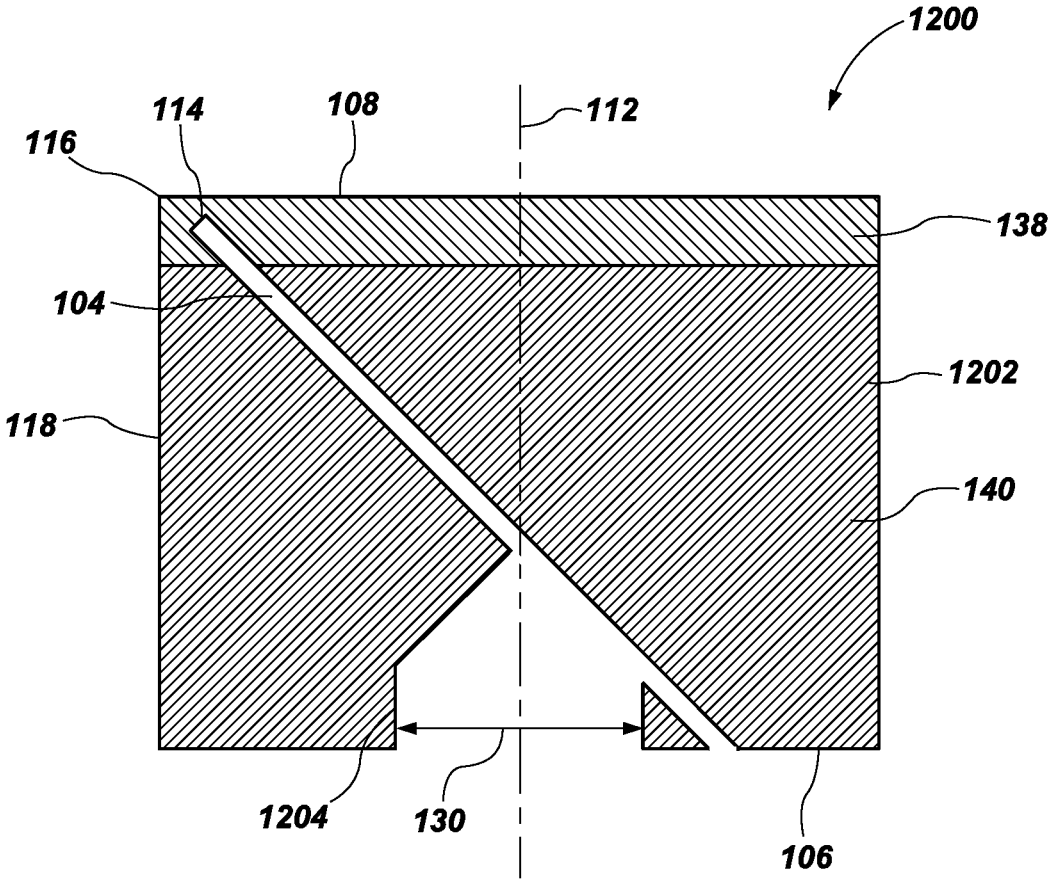
FIG. 12 is a cross-sectional side view of another embodiment of a first intermediate product in another process of forming another cutting element.

FIG. 12 is a cross-sectional side view of another embodiment of a first intermediate product 1200 in another process of forming another cutting element 1202. The other cutting element 1102 may be at least substantially similar to the cutting element 100 of FIG. 1, with at least some notable differences highlighted below. In some embodiments, cutting elements in accordance with this disclosure, such as the other cutting element 1102 of FIG. 11, may include second hole, such as the other second hole 1204 of FIG. 12, having a nonconstant second diameter 130. For example, the second diameter 130 of the other second hole 1204 may be at a maximum proximate to the back side 106 and may taper to a minimum as the other second hole 1204 approaches the cutting face 108. More specifically, the second diameter 130 of the other second hole 1204 may be at a maximum value proximate to the back side 106, may remain at the maximum value over a portion of the longitudinal extent of the other cutting element 1202 proximate to the back side, and may taper at least substantially continuously to a minimum value proximate to, and toward, an intersection with the first hole 104. As a specific, nonlimiting example, a portion of the other second hole 1204 proximate to the back side 106 may be shaped as a right cylinder, and a remainder of the other second hole 1204 located proximate to the cutting face may have a frustoconical shape. This kind of configuration for the second hole 126 may render inserting the sensor 102 (see FIG. 1) from the second hole 126 into the first hole 104 easier because the shape of the second hole 126 may guide a distal end of the sensor 102 toward the first hole 104.

Figure 13:
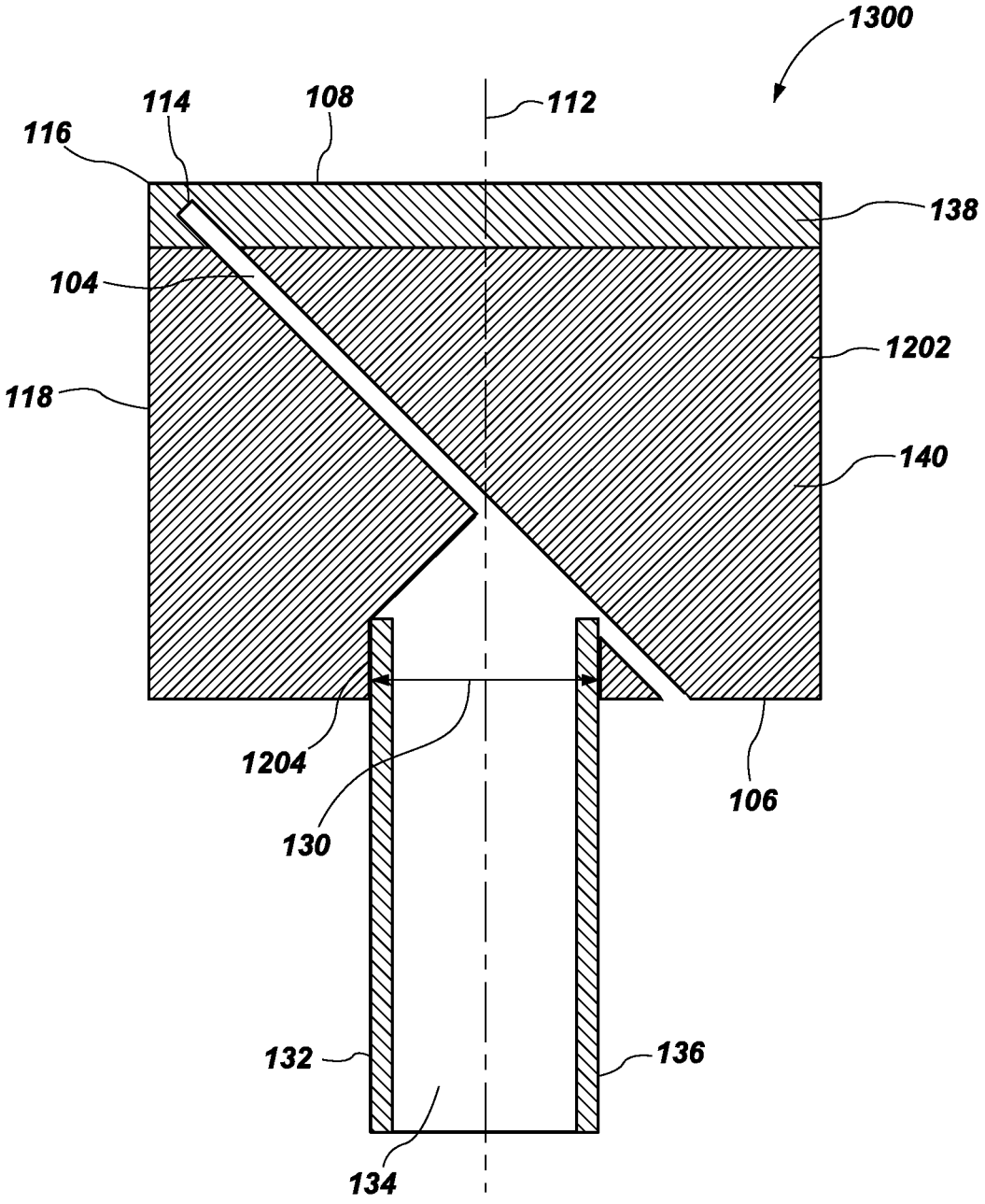
FIG. 13 is a cross-sectional side view of another embodiment of a second intermediate product in the other process of forming another cutting element of FIG. 12.

FIG. 13 is a cross-sectional side view of another embodiment of a second intermediate product 1300 in the other process of forming the other cutting element 1202 of FIG. 12. The extension 132 may be at least partially inserted into the other second hole 1204, and the extension 132 may be affixed to the cutting element 100. For example, the extension 132 may be inserted into that portion of the other second hole 1204 having the maximum second diameter 130 until the end of the extension 132 contacts a beginning of the tapered portion of the other second hole 1204. When the extension 132 contacts the beginning of the tapered portion of the other second hole 1204, the sidewalls 136 of the extension 132 may obstruct the portion of the first hole 104 extending from the other second hole 1204 to the back side 106, such that the portion of the first hole 104 extending from the other second hole 1204 to the back side 106 may not be in fluid communication with the other second hole 1204.

Figure 14:
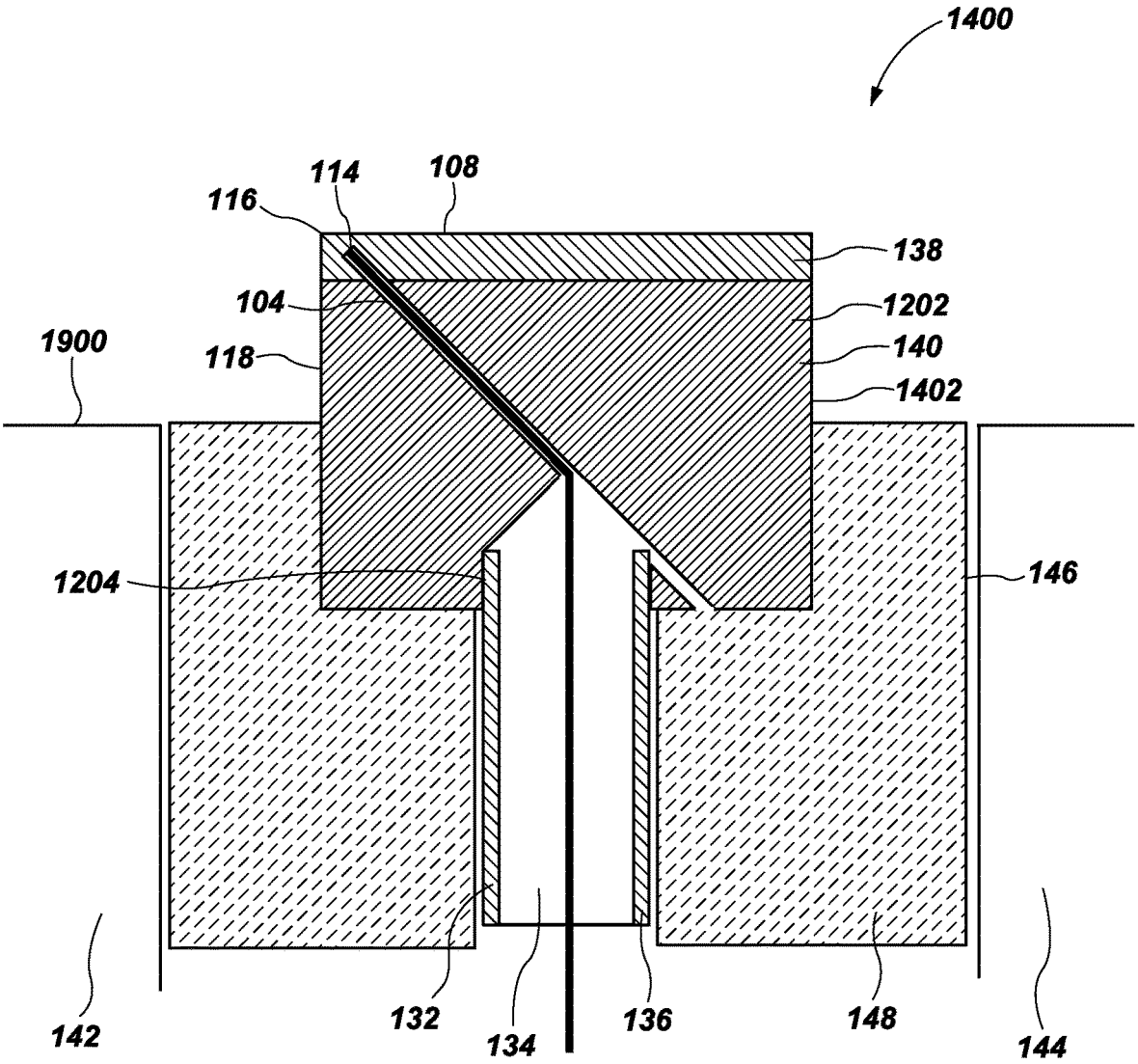
FIG. 14 is a cross-sectional side view of another embodiment of a cutting element in accordance with this disclosure, formed in accordance with the other process of FIG. 12 and FIG. 13.

FIG. 14 is a cross-sectional side view of another embodiment of a third intermediate product 1400 in a process of making a cutting element 1402 in accordance with this disclosure, formed in accordance with the other process of FIG. 12 and FIG. 13. The sensor 102 may be inserted into the first hole 104 via the passageway 134 extending through the extension 132 and via the second hole 126. When inserting a sensor 102 into the another cutting element 1202, the distal end of the sensor 102 may be inserted from the passageway 134 of the extension 132, through the portion of the other second hole 1204 having a tapered second diameter 130, and into the portion of the first hole 104 extending from the other second hole 1204 to the terminus 114 proximate to the cutting face 108 and/or the cutting edge 116. More specifically, the distal end of the sensor 102 may be inserted entirely through the passageway 134 of the extension 132, contacted against the tapered portion of the other second hole 1204, directed by the tapered portion of the other second hole 1204 toward the first hole 104, inserted into the portion of the first hole 104 extending toward the cutting face 108 and/or the cutting edge 116, and advanced to or proximate to the terminus 114 of the first hole 104.

Figure 15:
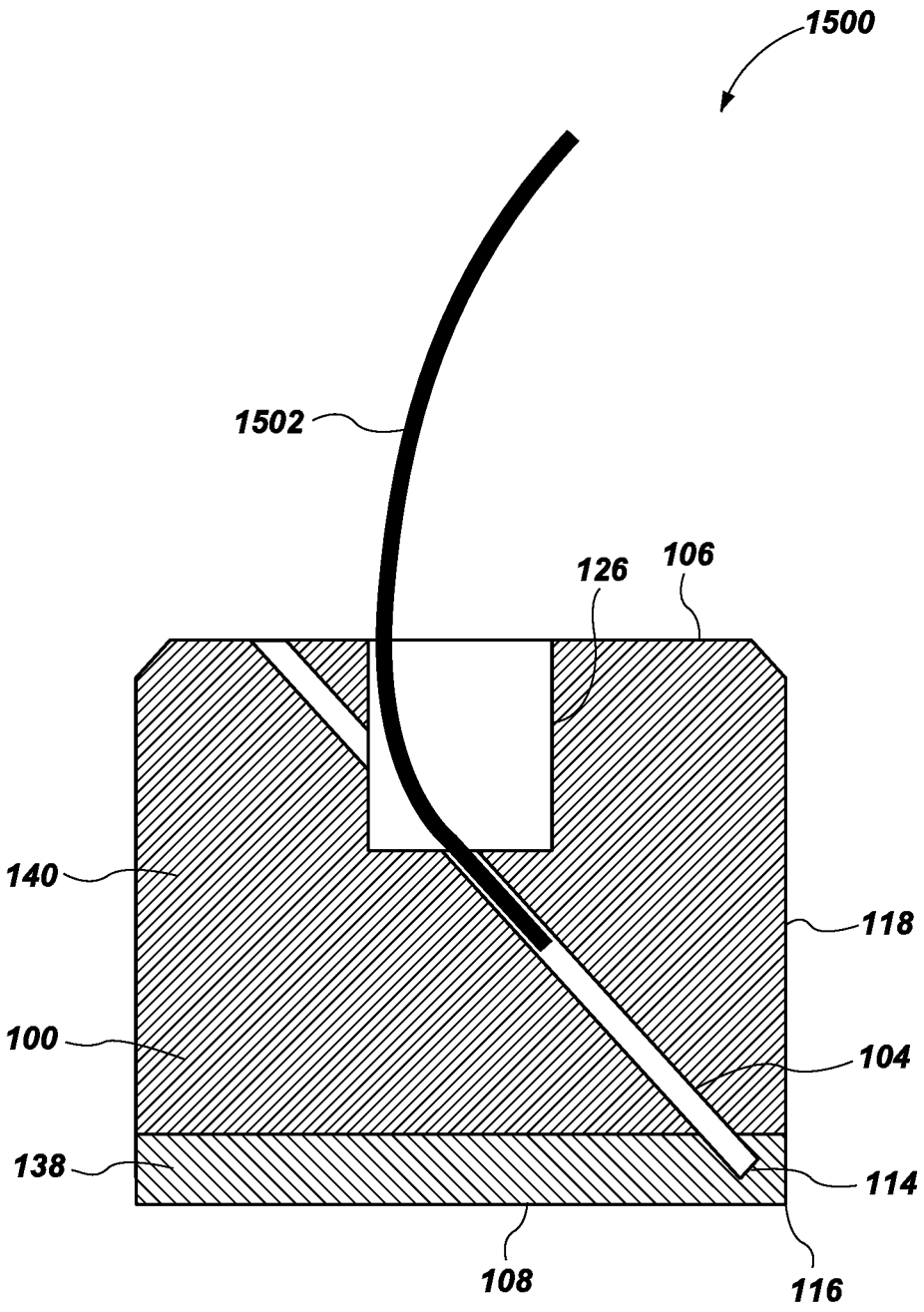
FIG. 15 is a cross-sectional side view of another embodiment of a first intermediate product in a process of forming a pathway for insertion of a sensor into the cutting element.

FIG. 15 is a cross-sectional side view of another embodiment of a first intermediate product 1500 in a process of forming a pathway for insertion of a sensor 102 into the cutting element 100. Following formation of the first hole 104 and the second hole 126, a temporary material 1502 may be inserted through the second hole 126 and into the first hole 104. The temporary material 1502 may include, for example, a flexible, elongated mass sized and shaped to obstruct the portion of the first hole 104 extending from the second hole 126 to the terminus 114. More specifically, the temporary material 1502 may include, for example, a metal or metal alloy material (e.g., steel), a polymer material, or a composite material in the form of a wire or tubing. The temporary material 1502 may further be configured to remain within the second hole 126 and at least a portion of the first hole 104 while a filler material is positioned in the second hole 126 around the temporary material 1502 and to be removable from within the second hole 126 and the first hole 104, leaving a pathway at least substantially matching the trajectory of the temporary material 1502 through the filler material and into the first hole 104. The temporary material 1502 may temporarily occupy, for example, between about 10% and about 100% of the length of the portion of the first hole 104 extending from the second hole 126 to the terminus 114. More specifically, the temporary material 1502 may temporarily occupy, for example, between about 15% and about 100% of the length of the portion of the first hole 104 extending from the second hole 126 to the terminus 114.

Figure 16:
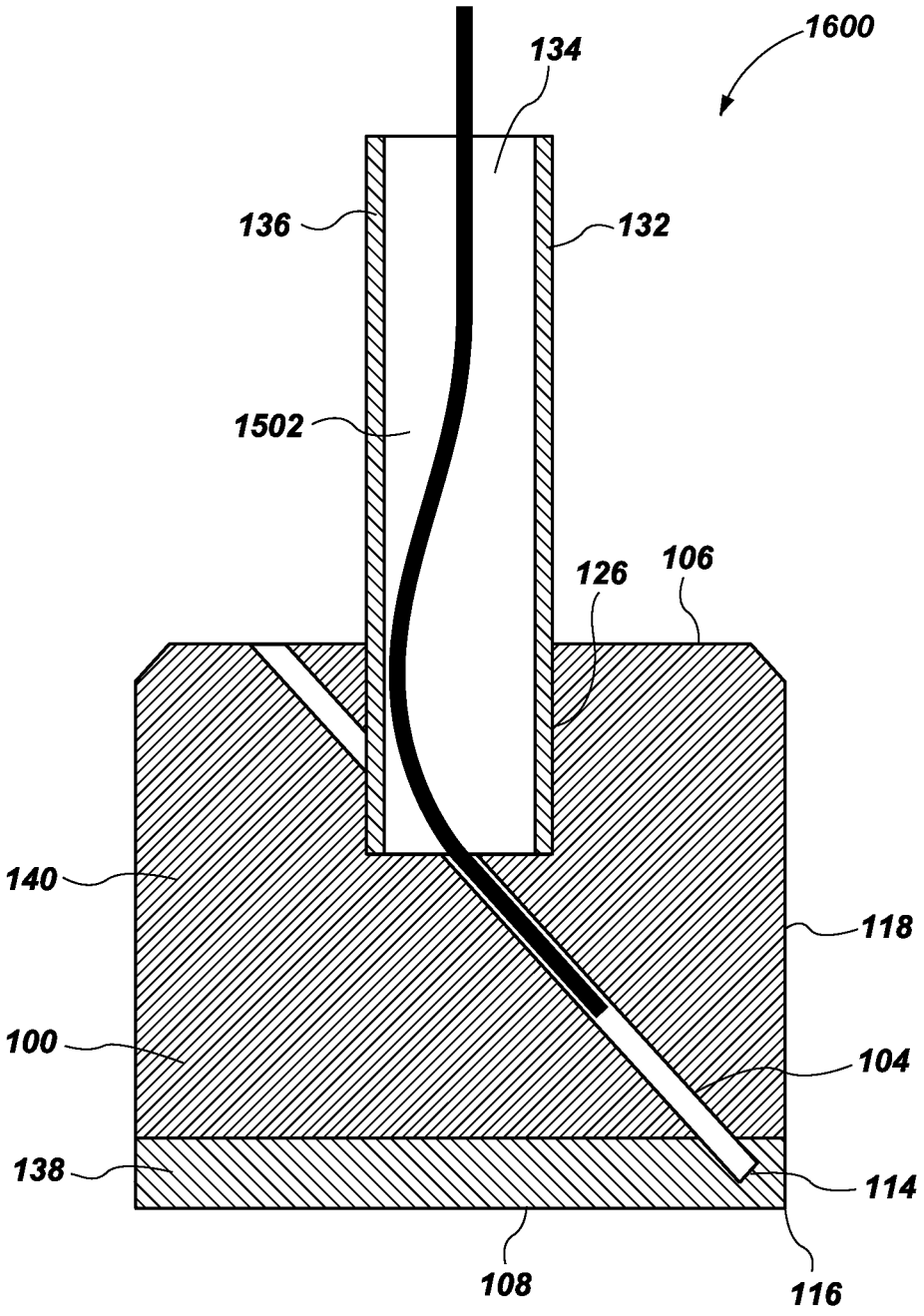
FIG. 16 is a cross-sectional side view of another embodiment of a second intermediate product in the process of forming the pathway of FIG. 15.

FIG. 16 is a cross-sectional side view of another embodiment of a second intermediate product 1600 in the process of forming the pathway following FIG. 15. The extension 132 may be inserted into the second hole 126, and the temporary material 1502 may extend through the passageway 134 through the extension 132, beyond the second hole 126, and into at least a portion of the first hole 104. In some embodiments, the extension 132 may be inserted into the second hole 126 and affixed to the cutting element 100 after the temporary material 1502 has been inserted at least partially into the first hole 104. In other embodiments, the extension 132 may be inserted into the second hole 126 and affixed to the cutting element 100 before the temporary material 1502 is inserted at least partially into the first hole 104.

Figure 17:
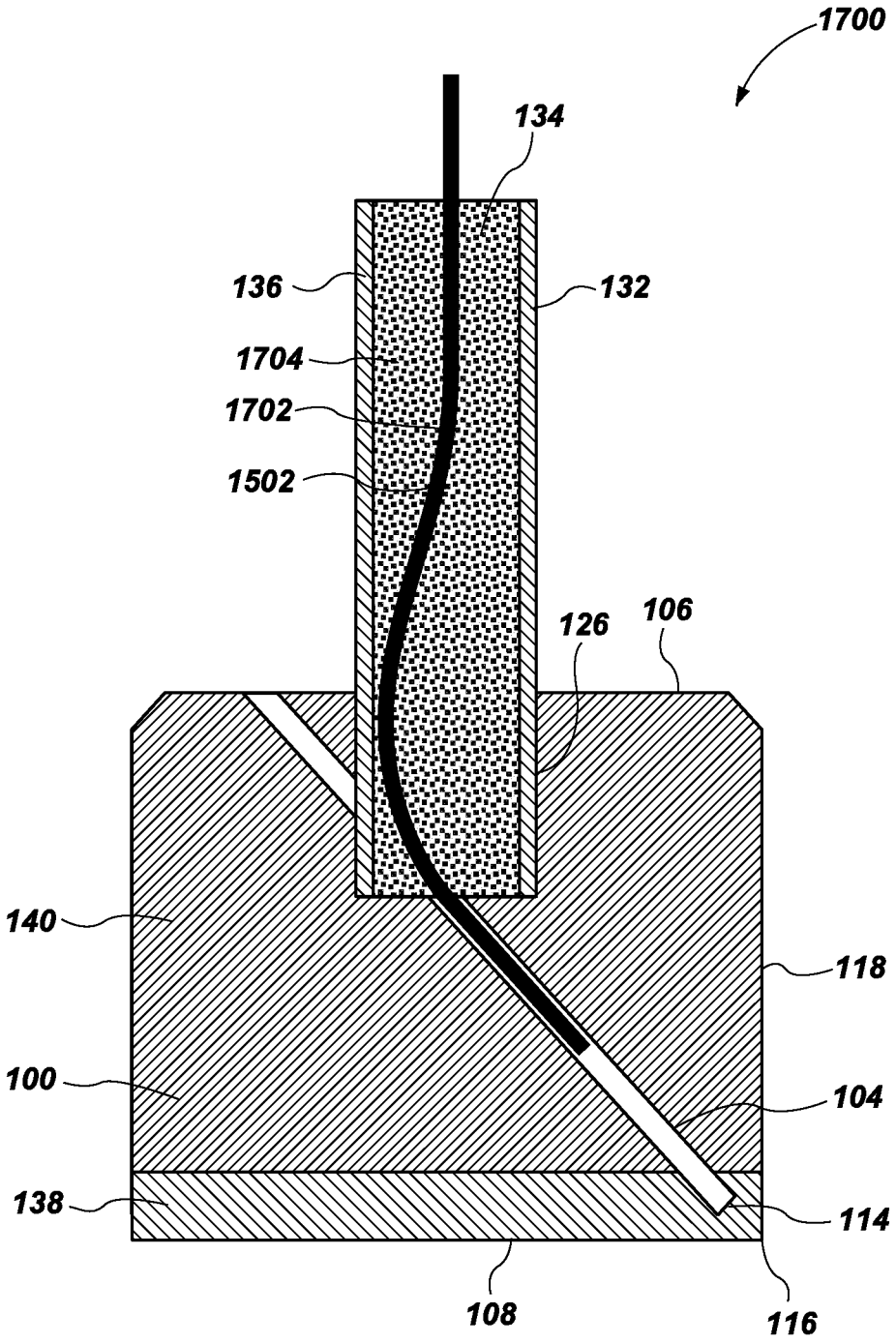
FIG. 17 is a cross-sectional side view of a third intermediate product in the process of forming the pathway following FIG. 16.

FIG. 17 is a cross-sectional side view of a third intermediate product 1700 in the process of forming the pathway 1702 following FIG. 16. The filler material 1704 may be introduced into the passageway 134 through the extension 132 and around the portion of the temporary material 1502 located within the passageway 134. For example, the filler material 1704 may include a filler material suitable for use in the downhole environment. More specifically, the filler material 1704 may include, for example, ceramic wool and/or or a high-temperature epoxy. As a specific, nonlimiting example, the filler material 1704 may include ceramic wool fibers bound in a high-temperature epoxy matrix. The filler material 1704 may be positioned in the passageway 134 by, for example, flowing the filler material 1704 into the passageway 134 when the filler material 1704 is in a flowable state and curing the filler material 1704 to fix the filler material 1704 in place within the passageway 134 and around the temporary material 1502. The temporary material 1502 and the sidewalls 136 of the extension 132 may impede (e.g., prevent) flow of the filler material 1704 in the flowable state from the passageway 134 into the first hole 104.

Figure 18:
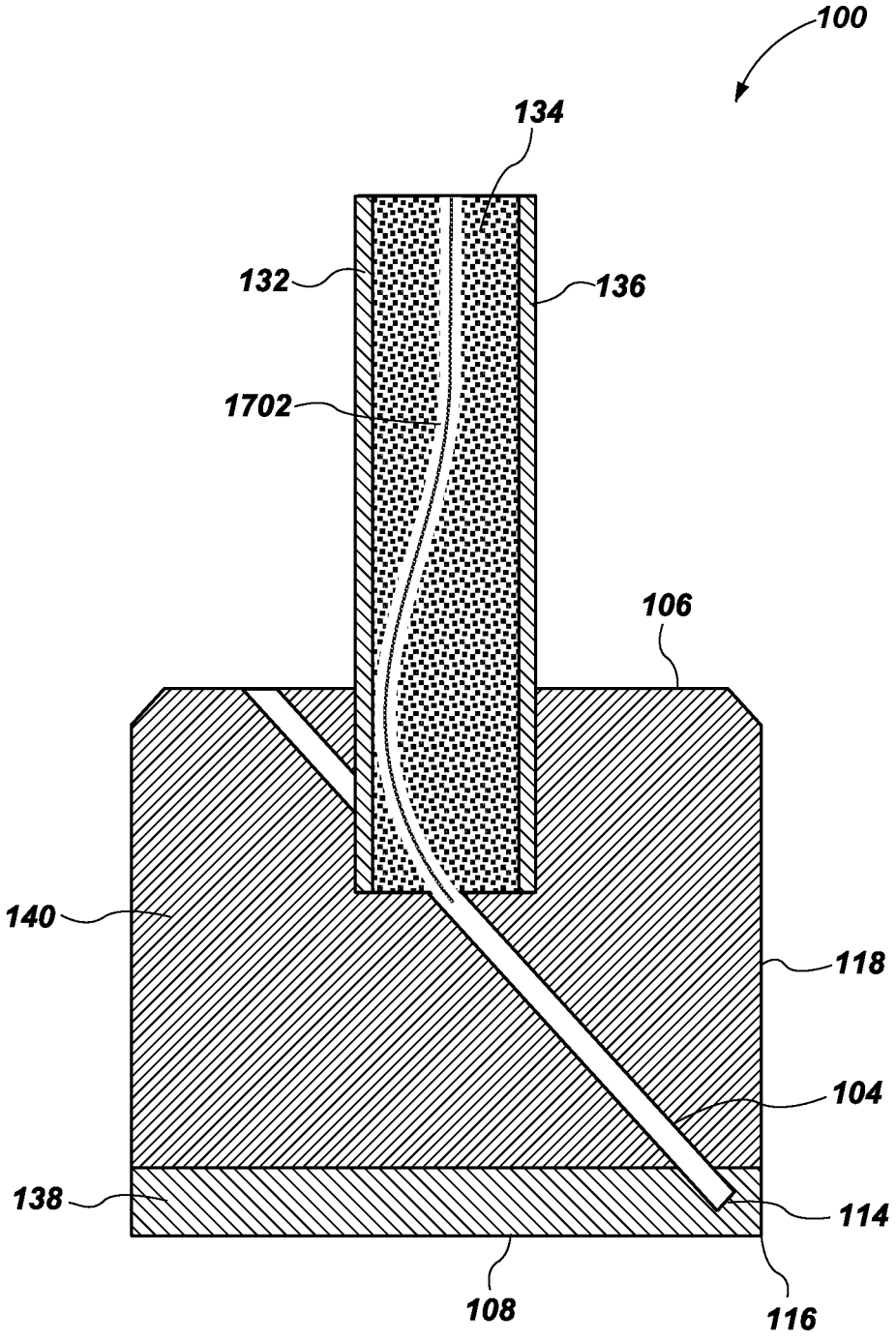
FIG. 18 is a cross-sectional side view of a cutting element including a pathway for insertion of a sensor formed in accordance with the process of FIG. 15, FIG. 16, and FIG. 17.

FIG. 18 is a cross-sectional side view of a cutting element 100 including a pathway 1702 for insertion of a sensor 102 (see FIG. 1) formed in accordance with the process of FIG. 15, FIG. 16, and FIG. 17. Once the filler material 1704 is fixed in the passageway 134, the temporary material 1502 may optionally be removed from within the first hole 104 and the filler material 1704 within the passageway 134, leaving a pathway 1702 extending through the filler material 1704 to the first hole 104. For example, the temporary material 1502 may be removed by mechanically pulling the temporary material 1502 out from the extension 132 or by placing the temporary material 1502 into a flowable state (e.g., by exposing the temporary material 1502 to elevated temperature or to a solvent). In some embodiments, removal of the temporary material 1502 may leave at least some residual temporary material 1502 within the pathway 1702 and/or may alter the trajectory of the pathway 1702 by also removing a portion of the filler material 1704. In other embodiments, removal of the temporary material 1502 may be at least substantially complete and/or may leave the trajectory of the pathway 1702 unaltered. In still other embodiments where the temporary material 1502 may be configured as tubing, the temporary material 1502 itself may define the pathway 1702 and the filler material 1704 may simply affix the temporary material and the pathway 1702 in place, such that the temporary material 1502 may remain in the passageway 134 of the extension 132. The pathway 1702 formed by any of the foregoing techniques may better guide the sensor 102 (see FIG. 1) toward and into the first hole 104. For example, the pathway 1702 may extend laterally from proximate to the portion of the first hole 104 extending from the back side 106 to the second hole 126 toward the portion of the first hole 104 extending from the second hole 126 to the terminus 114 as the pathway 1702 longitudinally approaches the portion of the passageway 134 proximate to the cutting face 108. As a result, the distal end of any sensor 102 (see FIG. 1) inserted therein may contact sidewalls of the filler material 1704 defining the pathway 1702, deflecting the sensor 102 (see FIG. 1) toward and into the first hole 104.

Figure 19:
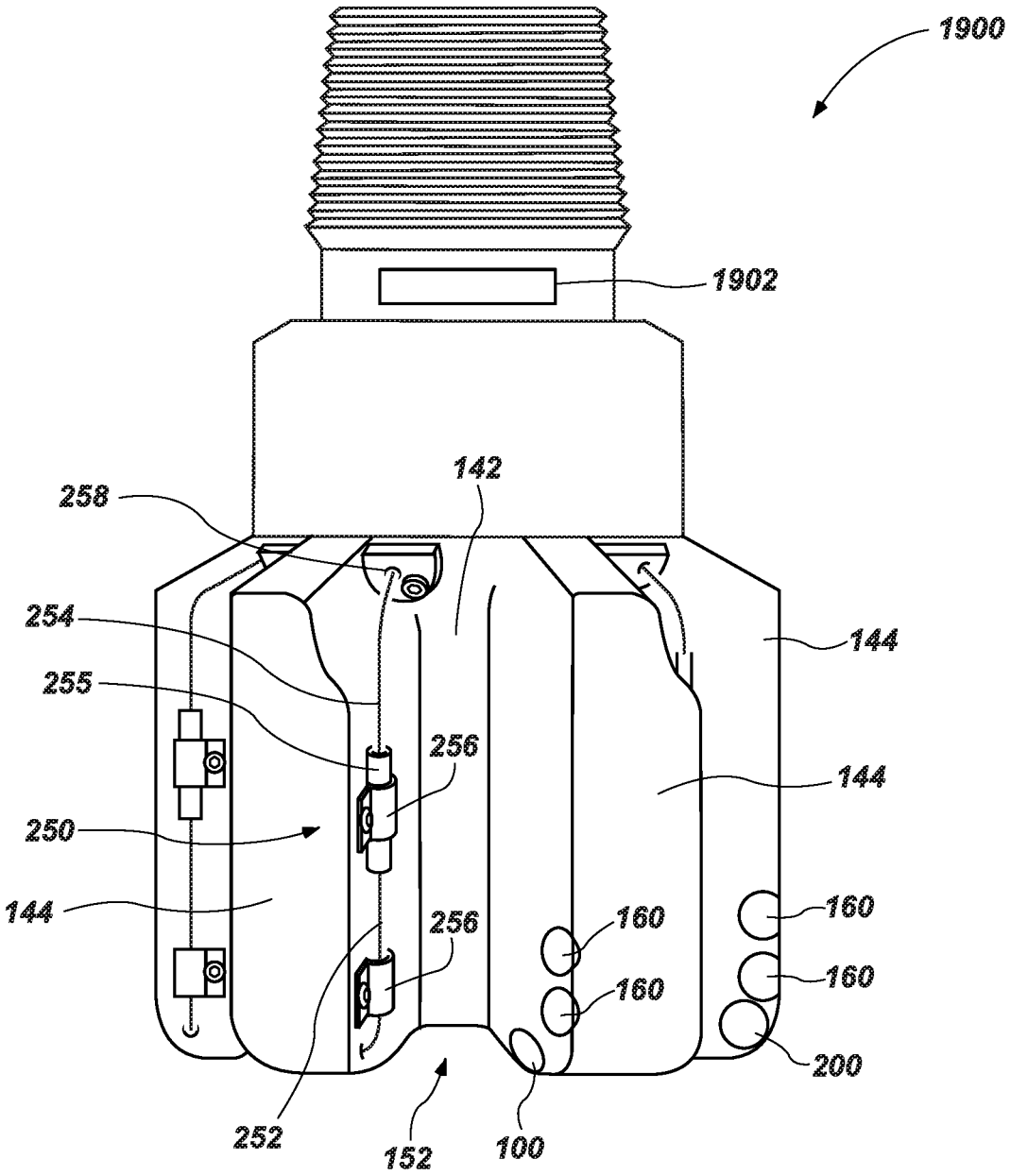
FIG. 19 is a perspective side view of an earth-boring tool including one or more instrumented cutting elements in accordance with this disclosure.

FIG. 19 is a perspective side view of an earth-boring tool 1900 including one or more instrumented cutting elements 100 in accordance with this disclosure. The earth-boring tool 1900 depicted in FIG. 19 is configured as a fixed-cutter earth-boring drill bit, though cutting elements 100 in accordance with this disclosure may be deployed with, and affixed to, other earth-boring tools known in the art. The earth-boring tool 1900 may include junk slots 152 that separate the blades 144 and with a conduit system 250 secured to the back surface of the blade 144. The conduit system 250 is configured to provide a protected passageway between the instrumented cutting element 100 to internal portions of the earth-boring tool 1900 where a data collection, processing, and/or transmission module 1902 may reside. In particular, a lead wire coupled to the sensor 102 (see FIG. 1) of the instrumented cutting element 100 be routed through aperture of the blade 144 as discussed more fully below, and further throughout the conduit system 250 to enter the bit body and couple with the data collection, processing, and/or transmission module 1902.

The conduit system 250 may extend along the external portion of the blade 144 through the junk slot 152 and couple to the earth-boring tool 1900 at a connection point with seal 258. The extended conductive wiring may be further routed within the earth-boring tool 1900 to reach the data collection, processing, and/or transmission module 1902. The conduit system 250 may include multiple sections that may be coupled together at different joints. For example, a first section 252 may extend into the aperture formed within the blade 144 and bend along the outer surface of the back side of the blade 144. The first section 252 may connect to a second section of 254 at joint 255 and continue to extend up the surface of the body 142 until a connection point for further entry into the body 142. Brackets 256 may be placed over the conduit system 250 to secure the conduit system to the blade 144. In some embodiments, the conduit system 250 may include a single section extending from the bottom of the blade 144 to the top region where the connection point to the body 142 is located. Having multiple sections may have the benefit of more easily replacing the wiring and/or the instrumented cutting element 100 by removing a second section 254 to access and disconnect the wiring.

The earth-boring tool 1900 may also optionally include non-instrumented cutting elements 160 affixed to the blades 144, in addition to the one or more instrumented cutting elements 100.

Figure 20:
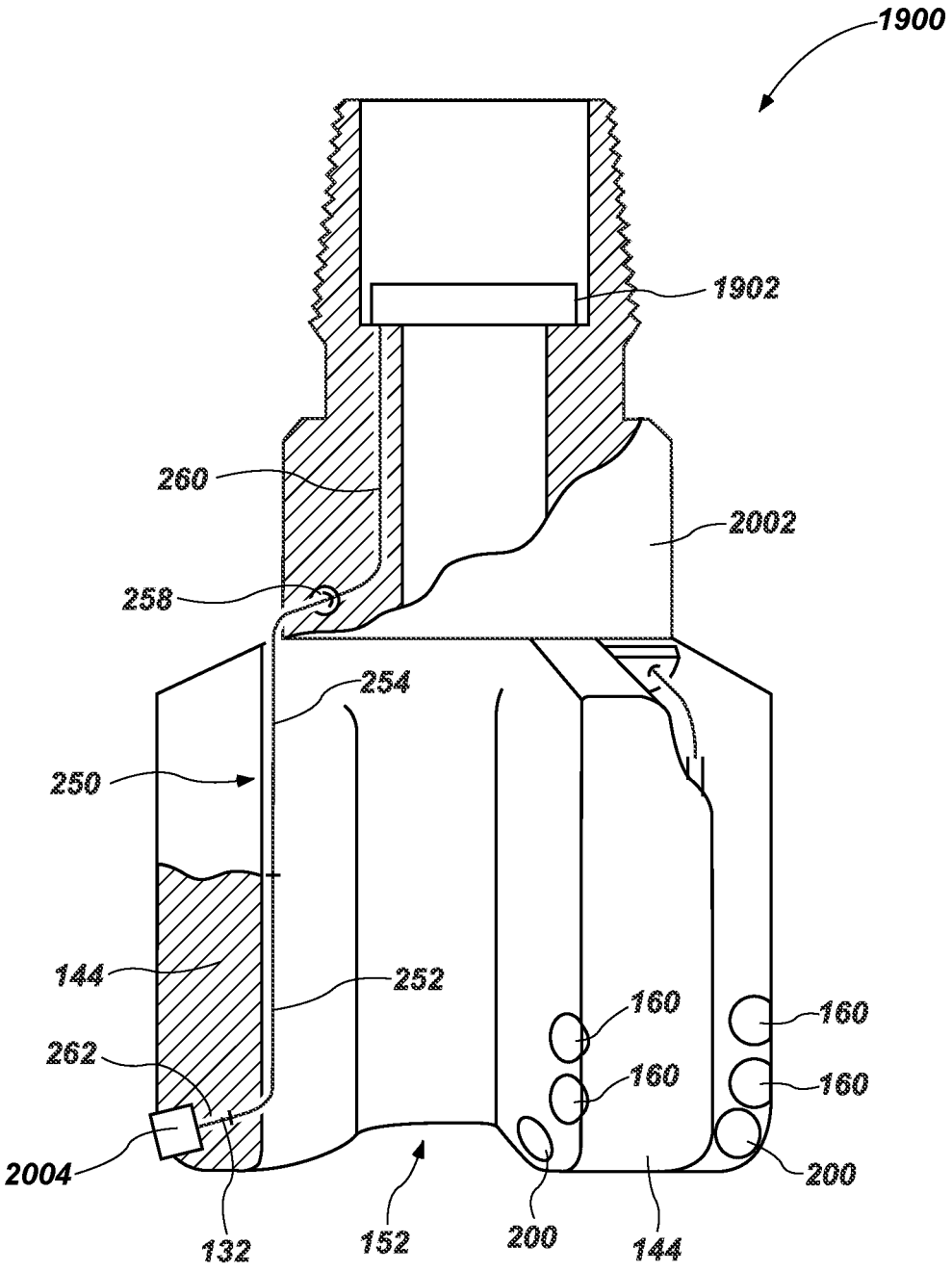
FIG. 20 is a partial cutaway side view of the earth-boring tool of FIG. 19.

FIG. 20 is a partial cutaway side view of the earth-boring tool 1900 of FIG. 19. Many details of the earth-boring tool 1900 are omitted for more clearly showing the extension 132 of the instrumented cutting element 2004 extending at least partially through the aperture 262 of the blade 144 to align with the portion of the first section 252 of the conduit system 250 that extends at least partially into the back side of the blade 144 to receive the conductive wiring. As the second section 254 of the conduit system 250 aligns with the internal passageways at the upper portion of the earth-boring tool 1900, a seal 258 may be placed at that connection point. A third section 260 of the conduit system 250 may be located within the shank 2002 and align with the upper portion of the second section 254 at or near the seal 258 to further guide the wiring to the data collection, processing, and/or transmission module 1902.

Techniques for forming instrumented cutting elements and affixing cutting elements to earth-boring tools, as well as the configurations for features of the cutting elements, in accordance with this disclosure may enable introduction of the sensor into the cutting element following affixation of the cutting element to the earth-boring tool. This change in timing may reduce exposure of the sensor to potentially harmful conditions that may occur during the process of affixing the cutting element to the earth-boring tool, such as elevated temperatures beyond the recommended operating temperatures for the sensor, which may cause the sensor to produce inaccurate signals, render the sensor inoperable, or otherwise damage the sensor. This change may also render affixing the cutting element to the earth-boring tool easier, as the operator and/or equipment performing the affixation process may not need to worry about keeping conditions during affixation, such as maximum temperatures and/or positioning of flowing braze material, within limits tied to protecting the sensor. In addition, techniques for forming instrumented cutting elements and affixing cutting elements to earth-boring tools, as well as the configurations for features of the cutting elements, in accordance with this disclosure may enable the sensor to be more easily introduced into, and properly positioned within, the cutting element. For example, the geometries and relative positions for features of instrumented cutting elements disclosed herein may better guide sensors into position, particularly when the cutting element has already been affixed to an earth-boring tool.

Additional nonlimiting embodiments within the scope of this disclosure include:

Embodiment 1. A method of forming an instrumented cutting element and affixing the instrumented cutting element to an earth-boring tool, comprising: forming a first hole over a first distance partially through a cutting element from a back side of the cutting element opposite a cutting face of the cutting element toward the cutting face, the first hole comprising a first maximum diameter; forming a second hole over a second, shorter distance partially through the cutting element from the back side of the cutting element toward the cutting face, the second hole comprising a second, larger maximum diameter, the second hole in fluid communication with the first hole; placing an extension comprising a passageway extending through the extension at least partially into the second hole, the passageway in fluid communication with the first hole; affixing the cutting element in a pocket extending into a body of an earth-boring tool; and inserting a thermocouple through the passageway and into the first hole after affixing the cutting element in the pocket.

Embodiment 2. The method of Embodiment 1, wherein forming the first hole comprises forming the first hole to be at least substantially straight.

Embodiment 3. The method of Embodiment 2, wherein forming the first hole comprises forming the first hole such that an angle between a geometrically central axis of the first hole and a geometrically central axis extending at least substantially perpendicular to the cutting face is between about 0° and about 60°.

Embodiment 4. The method of any one of Embodiments 1 through 3, wherein forming the first hole comprises positioning a terminus of the first hole proximate to the cutting face or proximate to a cutting edge of the cutting element.

Embodiment 5. The method of any one of Embodiments 1 through 4, further comprising forming additional first holes partially through the cutting element from the back side of the cutting element toward the cutting face, each first hole comprising the first maximum diameter, wherein forming the second hole comprises placing the second hole in fluid communication with each first hole, and further comprising inserting an additional thermocouple through the second hole and into a corresponding first hole until each first hole comprises a corresponding additional thermocouple inserted therein.

Embodiment 6. The method of any one of Embodiments 1 through 5, wherein forming the second hole comprises orienting a geometrically central axis of the second hole at least substantially parallel to a geometrically central axis of the cutting element extending at least substantially perpendicular to the cutting face.

Embodiment 7. The method of any one of Embodiments 1 through 6, wherein forming the second hole comprises causing the second diameter of the second hole to taper from the second, maximum diameter to a second, minimum diameter as the second hole approaches an intersection with a portion of the first hole extending from the second hole toward the cutting face.

Embodiment 8. The method of Embodiment 7, wherein placing the extension at least partially within the second hole comprises placing the extension within an untapered portion of the second hole.

Embodiment 9. The method of any one of Embodiments 1 through 6, further comprising placing a temporary material in a portion of the second hole and into the first hole, filling a remainder of the second hole with a filler material, and removing the temporary material, and wherein inserting the thermocouple through the second hole and into the first hole comprises inserting the thermocouple through the second hole and into the first hole via a pathway previously occupied by the temporary material.

Embodiment 10. The method of any one of Embodiments 1 through 9, wherein forming the first hole comprises removing material of the cutting element by laser drilling or electrical discharge machining the material of the cutting element to form the hole.

Embodiment 11. The method of claim 1, wherein affixing the cutting element in the pocket comprises brazing the cutting element in the pocket and further comprising exposing a portion of the first hole located proximate to the back side of the cutting element to a braze material.

Embodiment 12. An earth-boring tool, comprising: a cutting element brazed within a pocket extending into a body of the earth-boring tool, the cutting element comprising: a first hole extending over a first distance partially through the cutting element from a back side of the cutting element opposite a cutting face of the cutting element toward the cutting face, the first hole comprising a first maximum diameter; and a second hole extending over a second, shorter distance partially through the cutting element from the back side of the cutting element toward the cutting face, the second hole comprising a second, larger maximum diameter, the second hole in fluid communication with the first hole; an extension located at least partially within the second hole, the extension comprising a passageway extending through the extension and in fluid communication with the first hole; and a thermocouple extending through the passageway and into the first hole; and braze material affixing the cutting element within the pocket and exposed to a portion of the first hole located proximate to the back side of the cutting element.

Embodiment 13. The earth-boring tool of Embodiment 12, wherein an angle between a geometrically central axis of the first hole and a geometrically central axis extending at least substantially perpendicular to the cutting face is between about 0° and about 60°.

Embodiment 14. The earth-boring tool of Embodiment 12 or Embodiment 13, wherein a terminus of the first hole is located proximate to the cutting face or proximate to a cutting edge of the cutting element.

Embodiment 15. The earth-boring tool of claim 12, further comprising a filler material at least substantially filling a remainder of the second hole not occupied by the thermocouple.

Embodiment 16. The earth-boring tool of Embodiment 15, wherein the first hole is at least substantially straight along at least substantially an entirety of a length of the first hole.

Embodiment 17. The earth-boring tool of any one of Embodiments 12 through 16, wherein the second diameter of the second hole tapers from the second, maximum diameter to a second, minimum diameter as the second hole approaches an intersection with a portion of the first hole extending from the second hole toward the cutting face.

Embodiment 18. A method of forming an earth-boring tool including one or more instrumented cutting elements, comprising: brazing a cutting element in a pocket extending into a body of an earth-boring tool; exposing a portion of a first hole located proximate to a back side of the cutting element opposite the cutting face to flow of a braze material, the first hole extending over a first distance partially through the cutting element from the back side toward the cutting face, the first hole comprising a first maximum diameter; inhibiting flow of the braze material into a second hole and into a remainder of the first hole utilizing an extension located at least partially within the second hole, the second hole extending over a second, shorter distance partially through the cutting element from the back side of the cutting element toward the cutting face, the second hole comprising a second, larger maximum diameter, the second hole in fluid communication with the first hole located the portion of the first hole, the extension comprising a passageway extending through the extension and in fluid communication with the remainder of the first hole; and inserting a thermocouple through the passageway defined by the extension and into the remainder of the first hole.

Embodiment 19. The method of Embodiment 18, wherein inserting the thermocouple comprises inserting the thermocouple after brazing the cutting element in the pocket.

Embodiment 20. The method of Embodiment 18 or Embodiment 19, further comprising placing a temporary material in a portion of the second hole and into the first hole, filling a remainder of the second hole with a filler material, and removing the temporary material, and wherein inserting the thermocouple through the second hole and into the first hole comprises inserting the thermocouple through the second hole and into the first hole via a pathway previously occupied by the temporary material.

Embodiment 21. A method of making an earth-boring tool comprising one or more instrumented cutting elements, the comprising: placing a cutting element partially within a pocket extending into a body of an earth-boring tool, the cutting element comprising: a first hole extending over a first distance partially through the cutting element from a back side of the cutting element opposite a cutting face of the cutting element toward the cutting face, the first hole comprising a first maximum diameter; a second hole extending over a second, shorter distance partially through the cutting element from the back side of the cutting element toward the cutting face, the second hole comprising a second, larger maximum diameter, the second hole in fluid communication with the first hole; and an extension comprising a passageway extending through the extension located at least partially within the second hole, the passageway in fluid communication with the first hole; affixing the cutting element in the pocket; and inserting a thermocouple through the passageway and into the first hole after affixing the cutting element in the pocket.

Embodiment 22. The method of Embodiment 21, wherein placing the cutting element partially within the pocket comprises placing the cutting element, the cutting element comprising an at least substantially straight first hole, partially within the pocket.

Embodiment 23. The method of Embodiment 22, wherein placing the cutting element partially within the pocket comprises placing the cutting element, an angle between a geometrically central axis of the first hole and a geometrically central axis extending at least substantially perpendicular to the cutting face is between about 0° and about 60°, partially within the pocket.

Embodiment 24. The method of any one of Embodiments 21 through 23, wherein placing the cutting element partially within the pocket comprises placing the cutting element, a terminus of the first hole being located proximate to the cutting face or proximate to a cutting edge of the cutting element, partially within the pocket.

Embodiment 25. The method of any one of Embodiments 21 through 24, wherein placing the cutting element partially within the pocket comprises placing the cutting element, the cutting element comprising additional first holes partially through the cutting element from the back side of the cutting element toward the cutting face, each first hole comprising the first maximum diameter, the second hole being in fluid communication with each first hole, partially within the pocket, and further comprising inserting an additional thermocouple through the second hole and into a corresponding first hole until each first hole comprises a corresponding additional thermocouple inserted therein.

Embodiment 26. The method of any one of Embodiments 21 through 25, wherein placing the cutting element partially within the pocket comprises placing the cutting element, a geometrically central axis of the second hole being oriented at least substantially parallel to a geometrically central axis of the cutting element extending at least substantially perpendicular to the cutting face, partially within the pocket.

Embodiment 27. The method of any one of Embodiments 21 through 26, wherein placing the cutting element partially within the pocket comprises placing the cutting element, the second diameter of the second hole being tapered from the second, maximum diameter to a second, minimum diameter as the second hole approaches an intersection with a portion of the first hole extending from the second hole toward the cutting face, partially within the pocket.

Embodiment 28. The method of Embodiment 7, wherein placing the cutting element partially within the pocket comprises placing the cutting element, the extension being located within an untapered portion of the second hole, partially within the pocket.

Embodiment 29. The method of any one of Embodiments 21 through 28, further comprising placing a temporary material in a portion of the second hole and into the first hole, filling a remainder of the second hole with a filler material, and removing the temporary material, and wherein inserting the thermocouple through the second hole and into the first hole comprises inserting the thermocouple through the second hole and into the first hole via a pathway previously occupied by the temporary material.

Embodiment 30. The method of any one of Embodiments 21 through 29, further comprising forming by removing material of the cutting element by laser drilling or electrical discharge machining the material of the cutting element to form the hole.

Embodiment 31. The method of any one of Embodiments 21 through 30, wherein affixing the cutting element in the pocket comprises brazing the cutting element in the pocket and further comprising exposing a portion of the first hole located proximate to the back side of the cutting element to a braze material.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A method of making an earth-boring tool comprising one or more instrumented cutting elements, the method comprising:

placing a cutting element partially within a pocket extending into a body of an earth-boring tool, the cutting element comprising:

a first hole extending over a first distance partially through the cutting element from a back side of the cutting element opposite a cutting face of the cutting element toward the cutting face, the first hole comprising a first maximum diameter;

a second hole extending over a second, shorter distance partially through the cutting element from the back side of the cutting element toward the cutting face, the second hole comprising a second, larger maximum diameter, the second hole in fluid communication with the first hole; and an extension comprising a passageway extending through the extension located at least partially within the second hole, the passageway in fluid communication with the first hole;

affixing the cutting element in the pocket; and inserting a thermocouple through the passageway and into the first hole after affixing the cutting element in the pocket.

2. The method of claim 1, wherein placing the cutting element partially within the pocket comprises placing the cutting element, the first hole comprising an at least substantially straight portion, partially within the pocket.

3. The method of claim 2, wherein placing the cutting element partially within the pocket comprises placing the cutting element, an angle between a geometrically central axis of the first hole and a geometrically central axis extending at least substantially perpendicular to the cutting face is between about 0° and about 60°, partially within the pocket.

4. The method of claim 1, wherein placing the cutting element partially within the pocket comprises placing the cutting element, a terminus of the first hole being located proximate to the cutting face or proximate to a cutting edge of the cutting element, partially within the pocket.

5. The method of claim 1, wherein placing the cutting element partially within the pocket comprises placing the cutting element, the cutting element comprising additional first holes partially through the cutting element from the back side of the cutting element toward the cutting face, each first hole comprising the first maximum diameter, the second hole being in fluid communication with each first hole, partially within the pocket, and further comprising inserting an additional thermocouple through the second hole and into a corresponding first hole until each first hole comprises a corresponding additional thermocouple inserted therein.

6. The method of claim 1, wherein placing the cutting element partially within the pocket comprises placing the cutting element, a geometrically central axis of the second hole being oriented at least substantially parallel to a geometrically central axis of the cutting element extending at least substantially perpendicular to the cutting face, partially within the pocket.

7. The method of claim 1, wherein placing the cutting element partially within the pocket comprises placing the cutting element, the second diameter of the second hole being tapered from the second, maximum diameter to a second, minimum diameter as the second hole approaches an intersection with a portion of the first hole extending from the second hole toward the cutting face, partially within the pocket.

8. The method of claim 7, wherein placing the cutting element partially within the pocket comprises placing the cutting element, the extension being located within an untapered portion of the second hole, partially within the pocket.

9. The method of claim 1, further comprising placing a temporary material in a portion of the second hole and into the first hole, filling a remainder of the second hole with a filler material, and removing the temporary material, and wherein inserting the thermocouple through the second hole and into the first hole comprises inserting the thermocouple through the second hole and into the first hole via a pathway previously occupied by the temporary material.

10. The method of claim 1, further comprising forming by removing material of the cutting element by laser drilling or electrical discharge machining the material of the cutting element to form the first hole.

11. The method of claim 1, wherein affixing the cutting element in the pocket comprises brazing the cutting element in the pocket and further comprising exposing a portion of the first hole located proximate to the back side of the cutting element to a braze material.

12. An earth-boring tool, comprising:

a cutting element brazed within a pocket extending into a body of the earth-boring tool, the cutting element comprising:

a first hole extending over a first distance partially through the cutting element from a back side of the cutting element opposite a cutting face of the cutting element toward the cutting face, the first hole comprising a first maximum diameter; and a second hole extending over a second, shorter distance partially through the cutting element from the back side of the cutting element toward the cutting face, the second hole comprising a second, larger maximum diameter, the second hole in fluid communication with the first hole;

an extension located at least partially within the second hole, the extension comprising a passageway extending through the extension and in fluid communication with the first hole; and a thermocouple extending through the passageway and into the first hole; and braze material affixing the cutting element within the pocket and exposed to a portion of the first hole located proximate to the back side of the cutting element and located on a lateral side of the second hole opposite a lateral side on which a remainder of the first hole proximate to the cutting face is located.

13. The earth-boring tool of claim 12, wherein an angle between a geometrically central axis of the first hole and a geometrically central axis extending at least substantially perpendicular to the cutting face is between about 0° and about 60°.

14. The earth-boring tool of claim 12, wherein a terminus of the first hole is located proximate to the cutting face or proximate to a cutting edge of the cutting element.

15. The earth-boring tool of claim 12, further comprising a filler material at least substantially filling a remainder of the second hole not occupied by the thermocouple.

16. The earth-boring tool of claim 15, wherein the first hole is at least substantially straight along at least substantially an entirety of a length of the first hole.

17. The earth-boring tool of claim 12, wherein the second, larger maximum diameter of the second hole tapers from the second, larger maximum diameter to a second, minimum diameter as the second hole approaches an intersection with a portion of the first hole extending from the second hole toward the cutting face.

18. A method of forming an earth-boring tool comprising one or more instrumented cutting elements, the method comprising:

brazing a cutting element in a pocket extending into a body of an earth-boring tool;

exposing a portion of a first hole located proximate to a back side of the cutting element opposite a cutting face to flow of a braze material, the first hole extending over a first distance partially through the cutting element from the back side toward the cutting face, the first hole comprising a first maximum diameter;

inhibiting flow of the braze material into a second hole and into a remainder of the first hole utilizing an extension located at least partially within the second hole, the second hole extending over a second, shorter distance partially through the cutting element from the back side of the cutting element toward the cutting face, the second hole comprising a second, larger maximum diameter the second hole in fluid communication with the first hole, the extension comprising a passageway extending through the extension and in fluid communication with the remainder of the first hole; and inserting a thermocouple through the passageway defined by the extension and into the remainder of the first hole.

19. The method of claim 18, wherein inserting the thermocouple comprises inserting the thermocouple after brazing the cutting element in the pocket.

20. The method of claim 18, further comprising placing a temporary material in a portion of the second hole and into the first hole, filling a remainder of the second hole with a filler material, and removing the temporary material, and wherein inserting the thermocouple through the second hole and into the first hole comprises inserting the thermocouple through the second hole and into the first hole via a pathway previously occupied by the temporary material.

* * * * *